US011622216B2

(12) United States Patent
Davis et al.

(10) Patent No.: US 11,622,216 B2
(45) Date of Patent: Apr. 4, 2023

(54) SYSTEM AND METHOD FOR INTERACTIVE MOBILE FITTING OF HEARING AIDS

(71) Applicant: Team IP Holdings, LLC, Fort Worth, TX (US)

(72) Inventors: Keith L. Davis, Salt Lake City, UT (US); Lingming Wang, Southlake, TX (US); Todd J. Palmer, Salt Lake City, UT (US); Bennett Griffin, Lawrence, KS (US); Timothy D. Schnell, Del Mar, CA (US)

(73) Assignee: Team IP Holdings, LLC, Fort Worth, TX (US)

( * ) Notice: Subject to any disclaimer, the term of this patent is extended or adjusted under 35 U.S.C. 154(b) by 30 days.

(21) Appl. No.: 17/473,904

(22) Filed: Sep. 13, 2021

(65) Prior Publication Data

US 2022/0279296 A1 Sep. 1, 2022

Related U.S. Application Data

(60) Provisional application No. 63/154,441, filed on Feb. 26, 2021.

(51) Int. Cl.
*H04R 25/00* (2006.01)

(52) U.S. Cl.
CPC ..... *H04R 25/70* (2013.01); *H04R 25/30* (2013.01); *H04R 25/554* (2013.01)

(58) Field of Classification Search
CPC ..... H04R 25/70; H04R 25/30; H04R 25/554
USPC ..... 381/60
See application file for complete search history.

(56) References Cited

U.S. PATENT DOCUMENTS

| | | | | |
|---|---|---|---|---|
| 2016/0249356 | A1 | 8/2016 | Pope | |
| 2016/0337769 | A1 | 11/2016 | Siddhartha et al. | |
| 2020/0107139 | A1 | 4/2020 | Lugger et al. | |
| 2022/0400350 | A1 * | 12/2022 | De Vries | H04R 25/30 |

FOREIGN PATENT DOCUMENTS

| | | | | |
|---|---|---|---|---|
| EP | 1617705 | B1 | 3/2015 | |
| EP | 3288293 | A1 * | 2/2018 | H04R 25/505 |
| WO | WO-2015090381 | A1 * | 6/2015 | H04R 25/558 |

OTHER PUBLICATIONS

International Search Report for PCT Application No. PCT/US2022/014712 dated Apr. 26, 2022, 14 pages.

* cited by examiner

*Primary Examiner* — Phylesha Dabney
(74) *Attorney, Agent, or Firm* — McAndrews, Held & Malloy, Ltd.

(57) ABSTRACT

Systems and methods for interactive mobile fitting of hearing aids are provided. The method includes a mobile device receiving a reduced size fitting data set having a set of sampling points from a hearing aid. The method includes interpolating the reduced size fitting data set into a continuous fitting curve presented at a display of the mobile device with user interface objects that each correspond with one or more sampling points. The method includes receiving a user input manipulating a user interface object. The user input adjusts a value of sampling point(s) corresponding to the user interface object to generate an updated reduced size fitting data set that is communicated to the hearing aid. The method includes generating a substitute complete fitting data set based on the updated reduced size fitting data set for application to input audio to generate modified audio that is output from the hearing aid.

26 Claims, 12 Drawing Sheets

SYSTEM AND METHOD FOR INTERACTIVE MOBILE FITTING OF HEARING AIDS

CROSS-REFERENCE TO RELATED APPLICATIONS/INCORPORATION BY REFERENCE

The present application claims priority under 35 U.S.C. § 119(e) to provisional application Ser. No. 63/154,441 filed on Feb. 26, 2021, entitled "SYSTEM AND METHOD FOR INTERACTIVE MOBILE FITTING OF HEARING AIDS." The above referenced provisional application is hereby incorporated herein by reference in its entirety.

FIELD

The present disclosure relates to hearing aids. More specifically, the present disclosure relates to a system that reduces the complexity of modern digital hearing aid fittings and configuration data sets to a conceptually simple user interface, manageable by a hearing aid user, and available as an application on a mobile device, such as a smart-phone or tablet computer. The mobile device has a wireless connection to the hearing devices allowing configuration data to be communicated.

BACKGROUND

Hearing aids (HA) are typically customized for specific users by manufacturers and hearing care professionals (HCP). These customizations improve comfort and acoustic performance particular to a user's unique hearing impairment. The customizations include physical modifications to the device and configuration of electro-acoustic characteristics.

Personal sound amplification products (PSAP) and other in-ear devices that stream audio or amplify sounds with ambient noise features are typically distributed directly to a consumer, without assistance of a hearing care professional. Customizations made available to the user are typically limited to basic adjustments, such as volume control, low resolution equalization, and program selection among pre-programmed generic fittings.

The distinction between hearing aids and personal sound amplification products is disappearing with new regulations, new modes of distribution, and new technological capabilities that bridge the gap between these former U.S. Food and Drug Administration (FDA) designations. For purposes of the present disclosure, personal sound amplification products and other in-ear devices that stream audio or amplify sounds with ambient noise features are considered to be in the same class as hearing aids.

Remote control devices and smart-phone applications are currently available, which allow a user to make basic adjustments to the hearing aid device configuration, such as volume control, program selection, or basic equalization. Some applications also provide for remote communication between the user and a hearing care professional, where the hearing care professional can prepare and send a digital package of fitting information to the user's mobile device, which the user can then load into the hearing aid to change its electro-acoustic performance.

In digital hearing aid devices, the configuration data set can be large and complex, with thousands of parameters. Compression hearing aids have arrays of data to define a user's unique dynamic range and comfortable listening levels at many frequencies and in multiple compression channels. Algorithms for improved hearing in noisy, reverberant, or windy conditions, for example, contribute additional parametric complexity. Fitting software used by hearing care professionals provide access to a wide range of adjustments for maximal freedom to find solutions for a wide range of user problems. This type of fitting process can be confusing and time consuming without professional training. Furthermore, large data sets, which must be written to the hearing aid, introduce time delays long enough to prevent incremental and interactive adjustments. At the root, these adjustments are all based on the user's perceptual judgment of loudness and audibility.

Further limitations and disadvantages of conventional and traditional approaches will become apparent to one of skill in the art, through comparison of such systems with some aspects of the present disclosure as set forth in the remainder of the present application.

SUMMARY

Certain embodiments of the present technology provide a system and method for interactive mobile fitting of hearing aids, substantially as shown in and/or described in connection with at least one of the figures.

These and other advantages, aspects and novel features of the present disclosure, as well as details of an illustrated embodiment thereof, will be more fully understood from the following description and drawings.

DETAILED DESCRIPTION

Figure 1:
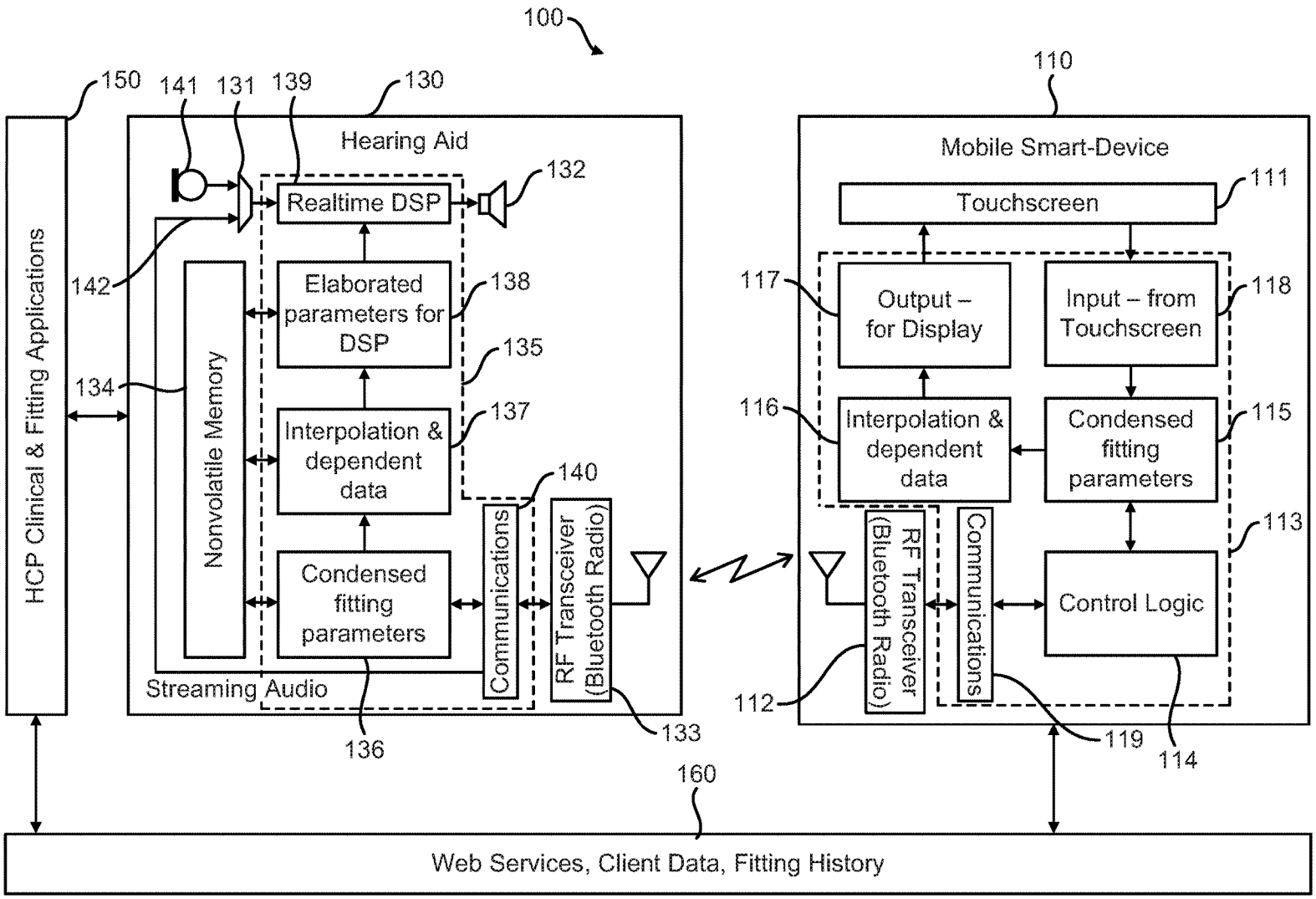
FIG. 1 illustrates a block diagram of an exemplary system configured to provide interactive mobile fitting of hearing aids, in accordance with embodiments of the present technology.

Embodiments of the present technology provide a system and method for interactive mobile fitting of hearing aids. Aspects of the present disclosure provide the technical effect of allowing a user to self-fit hearing aids without hearing care professional assistance. Various embodiments provide the technical effect of increasing user capability to provide improved adjustments that were formerly only possible with assistance from hearing care professionals. Certain embodiments provide the technical effect of making adjustments of the acoustic response in substantially real-time such that a user can hear the result of the adjustments substantially in real-time (i.e., within 500 milliseconds (ms) of the adjustment being made in the application).

Aspects of the present disclosure provide the technical effect of enabling remotely-located hearing care professionals providing telehealth applications to assist a user to create fittings or make adjustments interactively. Various embodiments leverage the training and experience of the hearing care professional to know which adjustments to make for particular hearing difficulty situations. Usage patterns and other situational data may be uploaded to a central server or database, for research and analysis contributing to continuous improvement of sound processing methods.

Aspects of the present disclosure provide the technical effect of reducing complex multi-dimensional arrays of data to smooth parametric curves on a grid that can be reshaped by a user, for example, by touching and sliding the graph displayed on the touch screen. Various embodiments provide the technical effect of using a reduced sized data set of parameters to specify the fitting curves, limited to a subset of the data for a fitting instead of the complete data set used by the runtime code in the hearing aid sound processors. Certain embodiments provide the technical effect of sending adjustments to the hearing aid devices in a flow-controlled stream of reduced sized packet transfers, which are interpreted and elaborated on the hearing aid device into the complete data set used for real-time audio signal processing. Aspects of the present disclosure provide the technical effect of performing computation to extrapolate and interpolate at both the mobile device (via the application) and by the hearing aid devices to reduce the bandwidth requirement in the communications channel between the mobile device and hearing aid devices. This redundant computation may assist the system in responding fast enough for the interactive user experience.

The foregoing summary, as well as the following detailed description of certain embodiments will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general-purpose signal processor or a block of random access memory, hard disk, or the like) or multiple pieces of hardware. Similarly, the programs may be stand alone programs, may be incorporated as subroutines in an operating system, may be functions in an installed software package, and the like. It should be understood that the various embodiments are not limited to the arrangements and instrumentality shown in the drawings. It should also be understood that the embodiments may be combined, or that other embodiments may be utilized, and that structural, logical and electrical changes may be made without departing from the scope of the various embodiments. The following detailed description is, therefore, not to be taken in a limiting sense, and the scope of the present disclosure is defined by the appended claims and their equivalents.

As used herein, an element or step recited in the singular and preceded with the word "a" or "an" should be understood as not excluding plural of said elements or steps, unless such exclusion is explicitly stated. Furthermore, references to "an exemplary embodiment," "various embodiments," "certain embodiments," "a representative embodiment," and the like are not intended to be interpreted as excluding the existence of additional embodiments that also incorporate the recited features. Moreover, unless explicitly stated to the contrary, embodiments "comprising", "including", or "having" an element or a plurality of elements having a particular property may include additional elements not having that property.

Additionally, the term interactive mobile fitting, as used herein, refers to both the creation of a fitting of hearing aids and the adjustment of a fitting of hearing aids. Also, the term hearing aid, as used herein, refers to hearing aids customized for specific users by manufacturers and hearing care professionals, personal sound amplification products, and any suitable in-ear devices that stream audio or amplify sounds with ambient noise features. Furthermore, the term processor or processing unit, as used herein, refers to any type of processing unit that can carry out the required calculations, execute algorithms, and make data-driven decisions needed for the various embodiments, such as single or multi-core: CPU, Accelerated Processing Unit (APU), Graphic Processing Unit (GPU), DSP, FPGA, ASIC or a combination thereof.

FIG. 1 illustrates a block diagram of an exemplary system 100 configured to provide interactive mobile fitting of hearing aids 130. Referring to FIG. 1, the system 100 includes a mobile smart-device (also referred to as a mobile device) 110, a hearing aid 130, a hearing care professional (HCP) system 150, and one or more servers 160.

The mobile smart-device 110 may comprise, for example, a smart phone, a tablet computer, or other handheld electronic device capable of communication with the hearing aid 130 via a wireless connection, such as Bluetooth, short-range, long range, Wi-Fi, cellular, personal communication system (PCS), or any suitable wireless connection. The mobile smart-device 110 may communicate with the one or more servers 160 via a wireless network and the Internet, for example. The wireless network may be one or more of a cellular, PCS, Wi-Fi, or other wireless communication network.

The mobile smart-device may include a display 111, user input devices 111, a memory, one or more processors 113, one or more communication components 112, and the like.

The display 111 may be any device capable of communicating visual information to a user. For example, a display 111 may include a liquid crystal display, a light emitting diode display, and/or any suitable display. The display 111 can be operable to display information from a software application, such as an interactive mobile hearing aid fitting application, or any suitable information. In various embodiments, the display 111 may display information provided by the one or more processors 113, for example.

The user input device(s) 111 may include a touchscreen, button(s), motion tracking, orientation detection, voice recognition, a mousing device, keyboard, camera, and/or any other device capable of receiving a user directive. In certain embodiments, one or more of the user input devices 111 may be integrated into other components, such as the display 111, for example. As an example, user input device may include a touchscreen display 111.

The memory (not shown) may be one or more computer-readable memories, for example, such as compact storage, flash memory, random access memory, read-only memory, electrically erasable and programmable read-only memory and/or any suitable memory. The memory may include databases, libraries, sets of information, or other storage accessed by and/or incorporated with the one or more processors 113, for example. The memory may be able to store data temporarily or permanently, for example. The memory may be capable of storing data generated by the one or more processors 113 and/or instructions readable by the one or more processors 113, among other things. In various embodiments, the memory stores information related to an interactive mobile hearing aid fitting application, for example.

The communication component(s) 112 allow communication between the mobile smart-device 110 and other external systems, such as the hearing aid 130 and the server(s) 160, for example. The communication component(s) 112 may include transceivers, such as Bluetooth, short-range, long range, Wi-Fi, cellular, personal communication system (PCS), or any suitable transceiver.

The one or more processors 113 may be one or more central processing units, microprocessors, microcontrollers, and/or the like. The one or more processors 113 may be an integrated component, or may be distributed across various locations, for example. The one or more processors 113 may be capable of executing a software application, receiving input information from a user input device 111 and/or communication connection(s) 112, and generating an output displayable by a display 111, among other things. In certain embodiments, the one or more processors 113 may communicate via communication connection(s) 112 with servers 160 to execute an interactive mobile hearing aid fitting application, for example. In an exemplary embodiment, the one or more processors 113 may communicate via communication connection(s) 112 with the hearing aid 130 to program the hearing aid with user-adjusted settings. For example, the one or more processor 113 may send adjustments to the hearing aid devices 130 in a flow-controlled stream of reduced sized packet transfers, which are interpreted and elaborated on the hearing aid device 130 into the complete fitting data set used for real-time audio signal processing.

The one or more processors 113 may comprise suitable logic, circuitry, interfaces, or code configured to reduce complex multi-dimensional arrays of data to smooth parametric curves on a grid that can be reshaped by a user. The processor(s) 113 may be configured to receive a reduced size fitting data set as communications 119 received from a hearing aid 130 via a communications component 112 at the mobile device 110. The reduced size fitting data set may be a set of sampling points from a complete fitting data set. The complete fitting data set may be a multi-dimensional array of fitting data. For example, the multi-dimensional array of fitting data may comprise a number of curves, such as a most comfortable level (MCL) curve, a maximum output level (MOL) curve designed to keep output audio levels below a user's loudness discomfort level (LDL), a maximum gain curve, a minimum gain curve, an acoustic audibility curve, an otoacoustic emissions (OAE) measurement curve, and the like. Each of the curves of the complete fitting data set may comprise a number of data points, such as 32-128 data points or any suitable number of data points. The reduced size fitting data set may comprise a set of sampling points (e.g., 9 sample points or any suitable number of sampling points less than a total number of sampling points from a curve of the complete fitting data set) from one of the curves of the complete fitting data set, such as the most comfortable level (MCL) curve or any suitable curve. The complete fitting data set may be manufacturers settings stored in the hearing aid 130 as part of the manufacturing process. Other subsequent processes may be used to further configure the hearing aids prior to interactive end-user adjustments. For example, fittings facilitated by a hearing care professional via the hearing care professional system 150 executing advanced fitting software may be used to generate the complete fitting data. As another example, the complete data set may be generated based on fitting algorithms for self-assessment, to create initial fittings based on an audiogram, according to a fitting rule, or rationale. The complete data set may also include fittings optimized through deep learning algorithms designed to discover user-preferred settings in a wide range of sound environments. Any or all of these initial fitting processes may be implemented on the mobile device 110, along with the interactive adjustment capability as described below.

The processor(s) 113 may comprise control logic 114 configured to control a flow of data between the processor(s) 113 and the other components of the mobile device 110, such as the communications component 112 and the touchscreen display 111. The processor(s) 113 may comprise suitable logic, circuitry, interfaces, or code configured to interpolate and generate dependent data 116 from the reduced size fitting data set 115 (also referred to as condensed fitting parameters as shown in FIG. 1). For example, the processor(s) 113 may interpolate 116 the reduced size fitting data set 115 by generating piecewise polynomial curves between sampling points of the set of sampling points to generate a continuous fitting curve represented by a high resolution array of discrete samples presented as a smooth curve 117 at the touchscreen 111 of the mobile device 110. The processor(s) may additionally and/or alternatively perform linear interpolation or any suitable interpolation method to generate the continuous fitting curve represented by a high resolution array of discrete samples presented as a smooth curve 117 at the touchscreen 111 of the mobile device 110. In various embodiments, the processor(s) may comprise suitable logic, circuitry, interfaces, or code configured to generate dependent data from the continuous fitting curve. As an example, the processor(s) may be configured to generate an MOL curve, a maximum gain curve, a minimum gain curve, and/or any suitable curve based on an interpolated MCL continuous fitting curve. The dependent data curves may additionally and/or alternatively be presented 117 at the touchscreen 111 of the mobile device 110.

The processor(s) 113 may be configured to present the continuous fitting curve with user interface objects at the display 111 of the mobile device 110. The user interface objects may each correspond with one sampling point from the set of sampling points of the reduced size fitting data set. The user interface objects may include visual indications of the objects or may be hidden objects. For example, the user interface objects may include sliders, handles, textual or numerical indicators, buttons, drop down menus, or the like presented at the display 111 for adjusting a value of the corresponding sampling point. As another example, the user interface objects may not include a visual indicator. For example, the user interface objects may be the sampling points on the continuous fitting curve presented in a same manner as the remainder of the continuous fitting curve. The user interface objects may be manipulated via a user input device (also referred to as a user interface) to increase or decrease a value of the sampling point. For example, a user finger or pointing device (e.g., mousing device) may be used to drag a user interface object up or down to increase or decrease the value of the sampling point. As another example, a user interface object may be selected and a button or knob may be manipulated to increase or decrease the value of the sampling point corresponding with the user interface object.

Additionally and/or alternatively, the processor(s) 113 may be configured to present a shape representing the continuous fitting curve with user interface objects at the display 111 of the mobile device 110. The shape may be a two-dimensional shape or three-dimensional shape. The shape may be a square, cube, circle, oval, or any suitable shape. The shape may correspond with the shape of an object, such as a soccer ball, star, apple, or any suitable object. The user interface objects may be sides, corners, edges, outer boundaries, points, or any suitable portions of the shape. The user interface objects may be manipulated, rotated or otherwise selected by the user through gesture controls such as dragging one's finger around the user interface to move, rotate or otherwise change the shape that appears on the touchscreen. The different sides or facets of the shape may be designated by different colors, shading, numbers, or any suitable indicator to help visualize which part of the shape is selected and active. These different sides or facets of the shape can in turn be mapped to sampling point combinations representing different configurations of the continuous fitting curve.

The processor(s) 113 may be configured to receive a user input 118 manipulating at least one of the user interface objects. The user input 118 adjusts a value of the one or more sampling points corresponding to the at least one of the user interface objects. The processor(s) 113 may be configured to generate an updated reduced size fitting data set 115 based on the received user input 118. The processor(s) 113 may comprise suitable logic, circuitry, interfaces, or code configured to interpolate and generate dependent data 116 from the updated reduced size fitting data set 115 as discussed above to update the continuous fitting curve 117 and any dependent data presented at the display 111 of the mobile device. The processor(s) 113 may be configured to communicate 119 the updated reduced size fitting data set 115, via the mobile device communication component 112, to the hearing aid 130 for application to input audio at the hearing aid 130 in substantially real-time (i.e., within 500 ms), such that a user can hear the result of the adjustments substantially in real-time.

The hearing aid 130 comprises an audio input 131, one or more receivers 132, memory 134, one or more hearing aid processors 135, and communication component(s) 133. The audio input 131 may comprise one or more microphones 141, streaming digital audio 142 receiving via communication component(s) 133, and/or any suitable audio input. The one or more microphones 141 are configured to receive sound exterior to an ear canal. The microphone(s) 141 convert the sound to electrical signals and provide the electrical signals to the one or more hearing aid processors 135 via the audio input 131. Additionally and/or alternatively, the audio input 131 may provide the one or more hearing aid processors 135 with streaming digital audio 142 or any suitable audio input. The one or more hearing aid processors 135 modify the sound level 139 by applying elaborated parameters 138 retrieved from memory 134 and/or generated based on reduced fitting data sets provided by the mobile smart-device 110. The one or more hearing aid processors 135 pass the electrical signals having the modified sound level to the receiver 132. The receiver 132 converts the electrical signals to sound, which is communicated from the receiver 132 to a user's ear canal.

The memory 134 may be a nonvolatile memory or any suitable memory configured to store a complete fitting data set, substitute complete fitting data set(s), reduced size fitting data sets, hearing aid processing instructions, and/or any suitable information.

The communication component(s) 133 allow communication between the hearing aid 130 and other external systems, such as the mobile smart-device 110 and the hearing care professional system 150, for example. The communication component(s) 133 may include wired and/or wireless communication interfaces. For example, the hearing aid 130 may communicate with the hearing care professional system 150 via wired communications, and may communicate with the mobile device 110 via wireless communications. The communications component 133 may include transceivers, such as Bluetooth, short-range, long range, Wi-Fi, cellular, personal communication system (PCS), or any suitable transceiver, configured to wirelessly communicate with the communications component 112 of the mobile device 110.

The hearing aid processor(s) 135 may be configured to generate, and/or retrieve from memory 134, a reduced size fitting data set from the complete fitting data set. The reduced size fitting data set 136 may be communicated 140 to the mobile device 110 via the communications component 133. The hearing aid processor(s) 135 may be configured to receive an updated reduced size fitting data set 136 as communications 140 received from the mobile device 110 via a communications component 133 at the hearing aid 130. The hearing aid processor(s) 135 may be configured to store the updated reduced size fitting data set 136 at memory 134. The hearing aid processor(s) 135 may comprise suitable logic, circuitry, interfaces, or code configured to interpolate and generate dependent data 137 from the updated reduced size fitting data set 136. For example, the hearing aid processor(s) 135 may interpolate 137 the reduced size fitting data set 115 by generating piecewise polynomial curves between sampling points of the set of sampling points and/or by any suitable interpolation method. The hearing aid processor(s) 135 may comprise suitable logic, circuitry, interfaces, or code configured to generate dependent data from the interpolated curve.

The hearing aid processor(s) 135 may be configured to generate a substitute complete fitting data set based on the interpolated curve and dependent data. In various embodiments, the substitute complete fitting data set is stored at memory 134 in addition to and/or separate from the original complete fitting data set. In an exemplary embodiment, the substitute complete fitting data set is stored at memory 134 in response to a command from the mobile device 110. In certain embodiments, the substitute complete fitting data set may be stored as a program that is selectable at the mobile device 110 for application at the hearing aid 130. The hearing aid processor(s) 135 may comprise suitable logic, circuitry, interfaces, or code configured to generate elaborated parameters for digital signal processing 138. For example, the hearing aid processor(s) 135 may be configured to reformat the substitute complete fitting data set for application to the input audio. The hearing aid processor(s) 135 may comprise suitable logic, circuitry, interfaces, or code configured to apply the elaborated parameters to input audio to generate modified audio 139. The modified audio may be output by the receiver 132 of the hearing aid 130 into an ear canal of the user.

In various embodiments, the one or more hearing aid processors 135, and communication components 133 may share various characteristics with the memory, one or more processors 113, and communication components 112 as described about with respect to the mobile smart-device 110.

The hearing care professional system 150 may include a personal computer, workstation, and/or any suitable computing device operated by a hearing care professional to communicate with the hearing aid 130 and server(s) 160. For example, the hearing care professional system 150 may be configured to replace a default manufacturer complete fitting data set or other complete fitting data set with a new complete fitting data set specific to a particular user of the hearing aid 130. In various embodiments, the hearing care professional system 150 may access substitute complete fitting data sets generated by a user of the mobile device 110 and stored in memory 134 of the hearing aid 130. The hearing care professional system 150 may communicate with the server(s) 160 via the Internet or any suitable communication connection to store or retrieve patient data, complete fitting data sets, hearing aid device information, purchase history, and/or any suitable information.

The one or more servers 160 may include web servers, database servers, and/or application servers, for example. The servers 160 may be configured to store a complete fitting data set, substitute complete fitting data sets, updated reduced fitting data sets, client data, and the like. For example, the mobile device 110 may communicate with the one or more servers 160 via the Internet or any suitable communication connection to provide updated reduced fitting data sets and/or to receive updated reduced fitting data sets prepared by a hearing care professional. As another example, the hearing care professional system 150 may communicate with the one or more servers 160 via the Internet or any suitable communication connection to provide or retrieve client data, complete fitting data sets, substitute complete fitting data sets, hearing aid device information and purchase history, and/or any suitable information. As another example, intensive computations may be offloaded from the hearing aid 130 or mobile device 110 to servers 160, and the computational results returned to the mobile device 110 and hearing aid 130 for real-time application.

In operation, the hearing aid 130 and mobile smart-device 110 establish a data connection, such as via Bluetooth or any suitable data connection. The mobile smart-device 110 may be configured to read condensed fitting parameters (i.e., reduced fitting data set) from the hearing aid 130. The condensed fitting parameters may be modified by the user via the mobile device user input device, such as a touchscreen 111, and written to the hearing aid 130 by the mobile smart-device 110.

A processor 135 of the hearing aid converts the condensed fitting parameters into the elaborated parameters for DSP (reformatted complete fitting data set). Either the reduced fitting data set, the complete fitting data set, or both may be stored in the nonvolatile memory 134 of the hearing aid 130. In addition, data sets may be stored in the hearing care professional system 150 and/or in a central database via web services 160. The hearing care professional system 150 and mobile smart device 110 may also have access to the same client data via the web service server(s) 160. The present disclosure primarily refers to a user's ability to interactively manipulate elaborated DSP parameters via a wireless connection. The redundant computation on a hearing aid 130 and mobile smart-device 110 reduce the data rate across the wireless connection.

Figure 2:
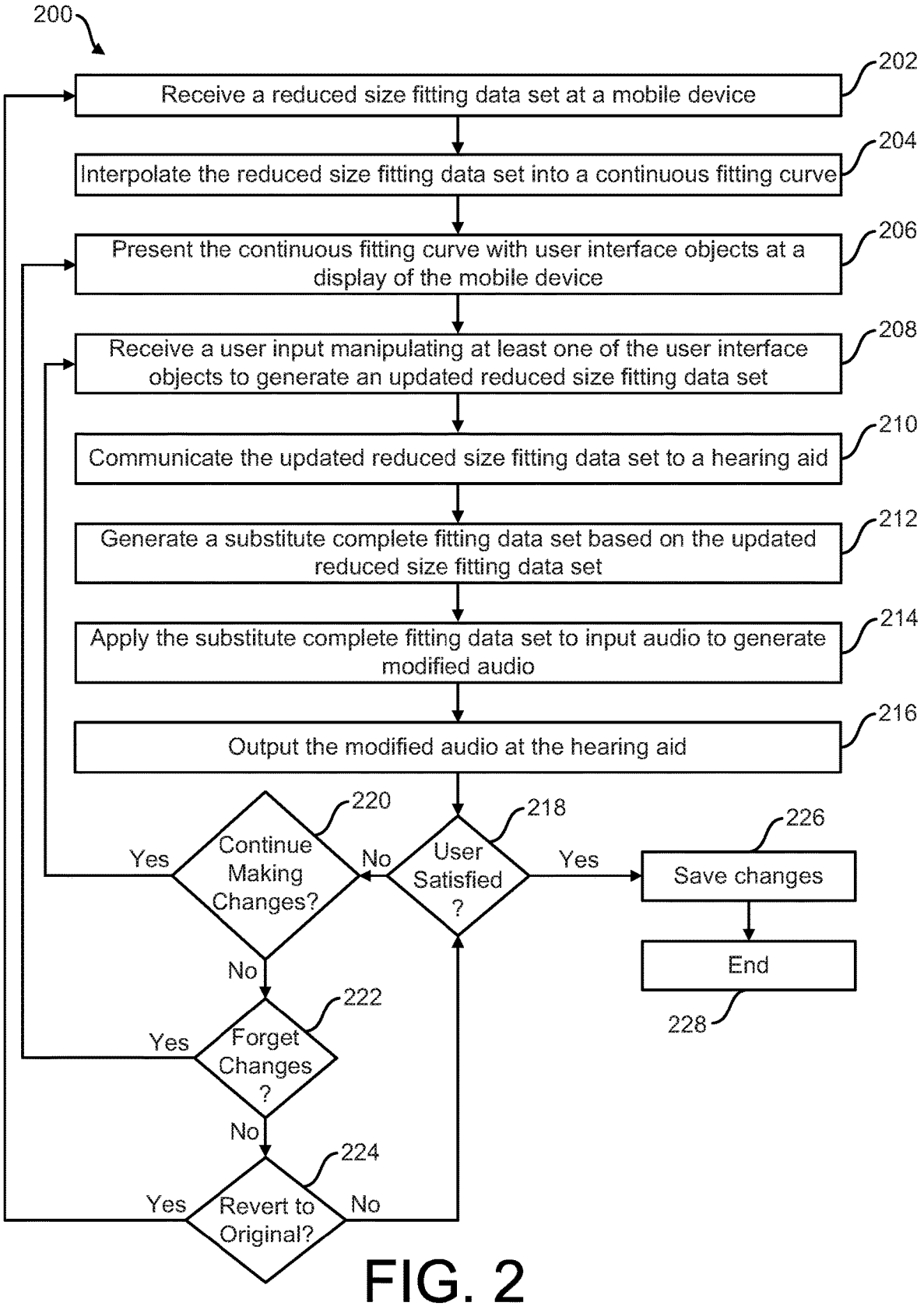
FIG. 2 is a flow chart illustrating exemplary steps that may be utilized for providing interactive mobile fitting of hearing aids, in accordance with embodiments of the present technology.

FIG. 2 is a flow chart 200 illustrating exemplary steps 202-228 that may be utilized for providing interactive mobile fitting of hearing aids 130, in accordance with embodiments of the present technology. Referring to FIG. 2, there is shown a flow chart 200 comprising exemplary steps 202 through 228. Certain embodiments may omit one or more of the steps, and/or perform the steps in a different order than the order listed, and/or combine certain of the steps discussed below. For example, some steps may not be performed in certain embodiments. As a further example, certain steps may be performed in a different temporal order, including simultaneously, than listed below.

At step 202, a mobile device 110 receives a reduced size fitting data set from a hearing aid 130. For example, at least one processor 113 of the mobile device may be configured to receive a reduced size fitting data set as communications 119 received from a hearing aid 130 via a communications component 112 at the mobile device 110. The reduced size fitting data set may be a set of sampling points from a complete fitting data set stored at memory 134 of the hearing aid 130.

At step 204, at least one processor 113 of the mobile device 110 interpolates the reduced size fitting data set into a continuous fitting curve 117. For example, the at least one processor 113 may be configured to interpolate 116 the reduced size fitting data set 115 by generating piecewise polynomial curves between sampling points of the set of sampling points, or any suitable interpolation method, to generate the continuous fitting curve represented by a high resolution array of discrete samples presented as a smooth curve 117 at a display 111 of the mobile device 110.

At step 206, the at least one processor 113 of the mobile device 110 presents the continuous fitting curve 117 with user interface objects at a display 111 of the mobile device 110. For example, the user interface objects may each correspond with one sampling point from the set of sampling points of the reduced size fitting data set. The user interface objects may include visual indications of the objects or may be hidden objects. For example, the user interface objects may include sliders, handles, textual or numerical indicators, buttons, drop down menus, or the like presented at the display 111 for adjusting a value of the corresponding sampling point. As another example, the user interface objects may not include a visual indicator. For example, the user interface objects may be the sampling points on the continuous fitting curve presented in a same manner as the remainder of the continuous fitting curve. In various embodiments, the continuous fitting curve may be represented by a shape presented at the display 111 as described below with respect to FIGS. 11 and 12. For example, the shape may be a two-dimensional shape or three-dimensional shape. The shape may be a square, cube, circle, oval, or any suitable shape. The shape may correspond with the shape of an object, such as a soccer ball, star, apple, or any suitable object. The user interface objects may be sides, corners, edges, outer boundaries, points, or any suitable portions of the shape. The user interface objects may be different sides or facets of the shape, which in turn may be mapped to sampling point combinations representing different configurations of the continuous fitting curve.

At step 208, a user input 118 manipulating at least one of the user interface objects is received at the mobile device 110 to generate an updated reduced size fitting data set. For example, the user interface objects may be manipulated via a user input device to increase or decrease a value of the sampling point. As another example, the user interface objects of a shape representing the continuous fitting curve may be manipulated, rotated or otherwise selected via a user input device to adjust values of one or more sampling points. The at least one processor 113 of the mobile device 110 may be configured to generate an updated reduced size fitting data set 115 based on the received user input 118.

At step 210, the mobile device 110 communicates the updated reduced size fitting data set to the hearing aid 130. For example, at least one hearing aid processor 135 of the hearing aid 130 may be configured to receive an updated reduced size fitting data set 136 as communications 140 received from the mobile device 110 via a communications component 133 at the hearing aid 130.

At step 212, at least one hearing aid processor 135 of the hearing aid 130 generates a substitute complete fitting data set based on the updated reduced size fitting data set. For example, the at least one hearing aid processor 135 may interpolate 137 the reduced size fitting data set 115 by generating piecewise polynomial curves between sampling points of the set of sampling points and/or by any suitable interpolation method. The at least one hearing aid processor 135 may be configured to generate a substitute complete fitting data set based on the interpolated curve.

At step 214, the at least one hearing aid processor 135 applies the substitute complete fitting data set to input audio to generate modified audio. For example, the at least one hearing aid processor 135 may be configured to generate elaborated parameters for digital signal processing 138 by reformatting the substitute complete fitting data set for application to the input audio. The at least one hearing aid processor 135 may apply the elaborated parameters to input audio to generate modified audio 139.

At step 216, the hearing aid 130 outputs the modified audio. For example, the modified audio may be output by a receiver 132 of the hearing aid 130 into an ear canal of the user.

At step 218, if a user is not satisfied with the modified audio, the process proceeds to step 220 as described below. If the user is satisfied with the modified audio, the process proceeds to step 226 as described below.

At step 220, a user may continue making changes to the continuous fitting curve as modified by the previous user input manipulations by returning to step 208 to provide additional user input manipulations if the user is not satisfied with the modified audio. If the user does not want to continue making changes, the process proceeds to step 222.

At step 222, the user may provide a selection via the user interface 111, 900, 910 to forget the session changes 930. The process 200 then returns to step 206 where the continuous fitting curve prior to the user manipulations is presented with the user interface objects at the display 111 of the mobile device 110. If the user does not want to forget the session changes and return to the continuous fitting curve prior to user manipulations, the process 200 proceeds to step 224.

At step 224, the user may provide a selection via the user interface 111, 900, 910 to revert back to the original complete fitting data set (e.g., prior to any substitute complete fitting data set being generated). The process 200 then returns to step 202 where a reduced size fitting data set corresponding to the original complete fitting data set is received from the hearing aid 130 at the mobile device 110. If the user does not want to revert back to the original complete fitting data set, the process returns to step 218.

At step 226, the user may provide a selection via the user interface 111, 358, 720 of the mobile device 110 to store the substitute complete fitting data set at nonvolatile memory 134 of the hearing aid 130. In various embodiments, the user may select to store the substitute complete fitting data set as a program. For example, the substitute complete fitting data may be stored as a default program, a program for noisy environments, a program for music listening, a program for windy environments, or any suitable program. The stored program may be selected via the user interface 111 of the mobile device 110 for application by the hearing aid 130 to input audio.

At step 228, the process 200 ends.

FIGS. 3-10 illustrate exemplary user interface screenshots 300-1000 that may be provided to a user via the display 111 of the mobile smart-device 110. Although FIGS. 3-10 illustrate an acoustic frequency range from 250 Hz to 6000 Hz, other frequency ranges may be provided, such as for devices having frequency ranges extending up to 20,000 Hz, among other things.

Figure 3:
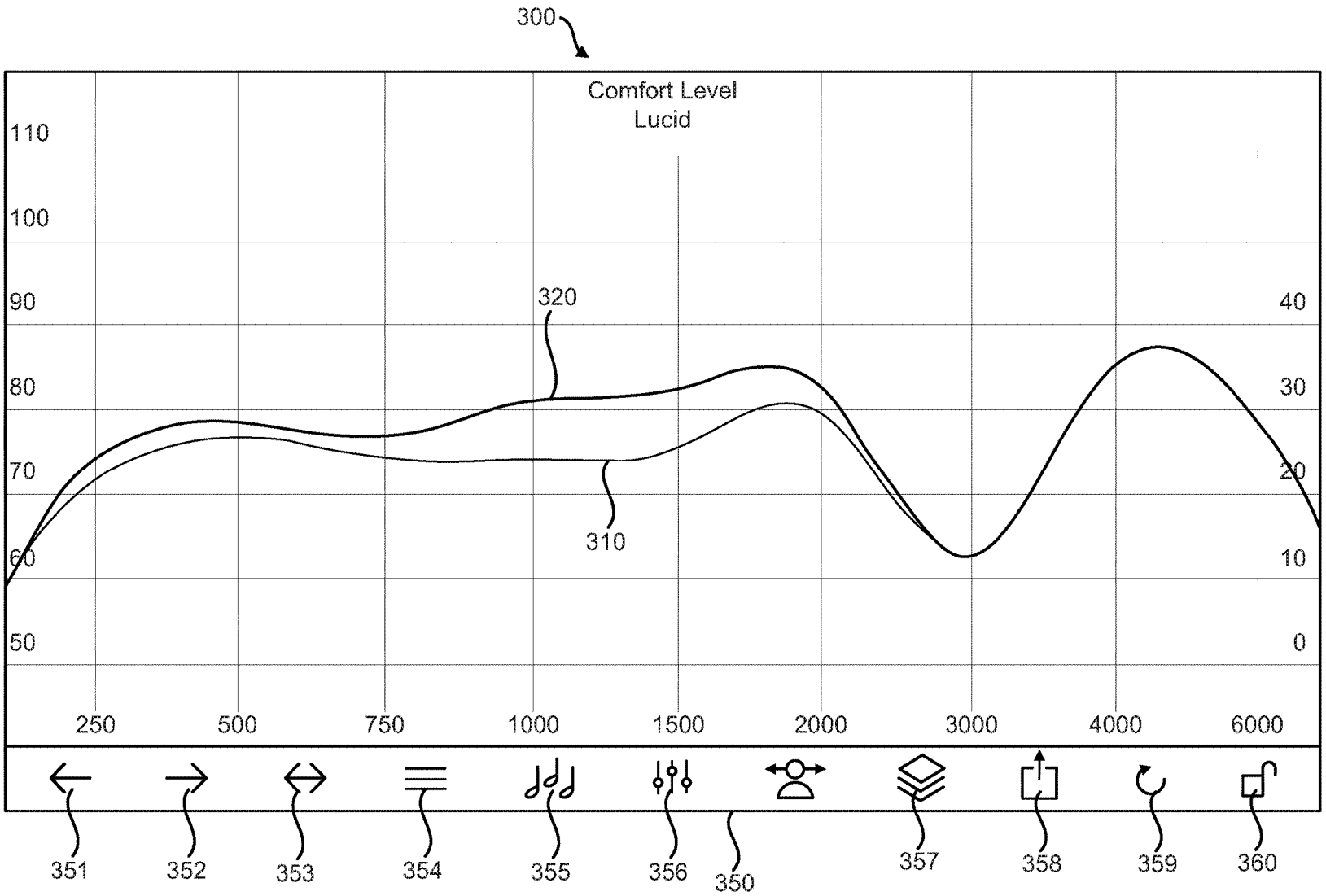
FIG. 3 illustrates a user interface screenshot of an exemplary comfort target for a left hearing aid, by frequency, with a default target predicted by audiogram, in accordance with embodiments of the present technology.
Figure 5:
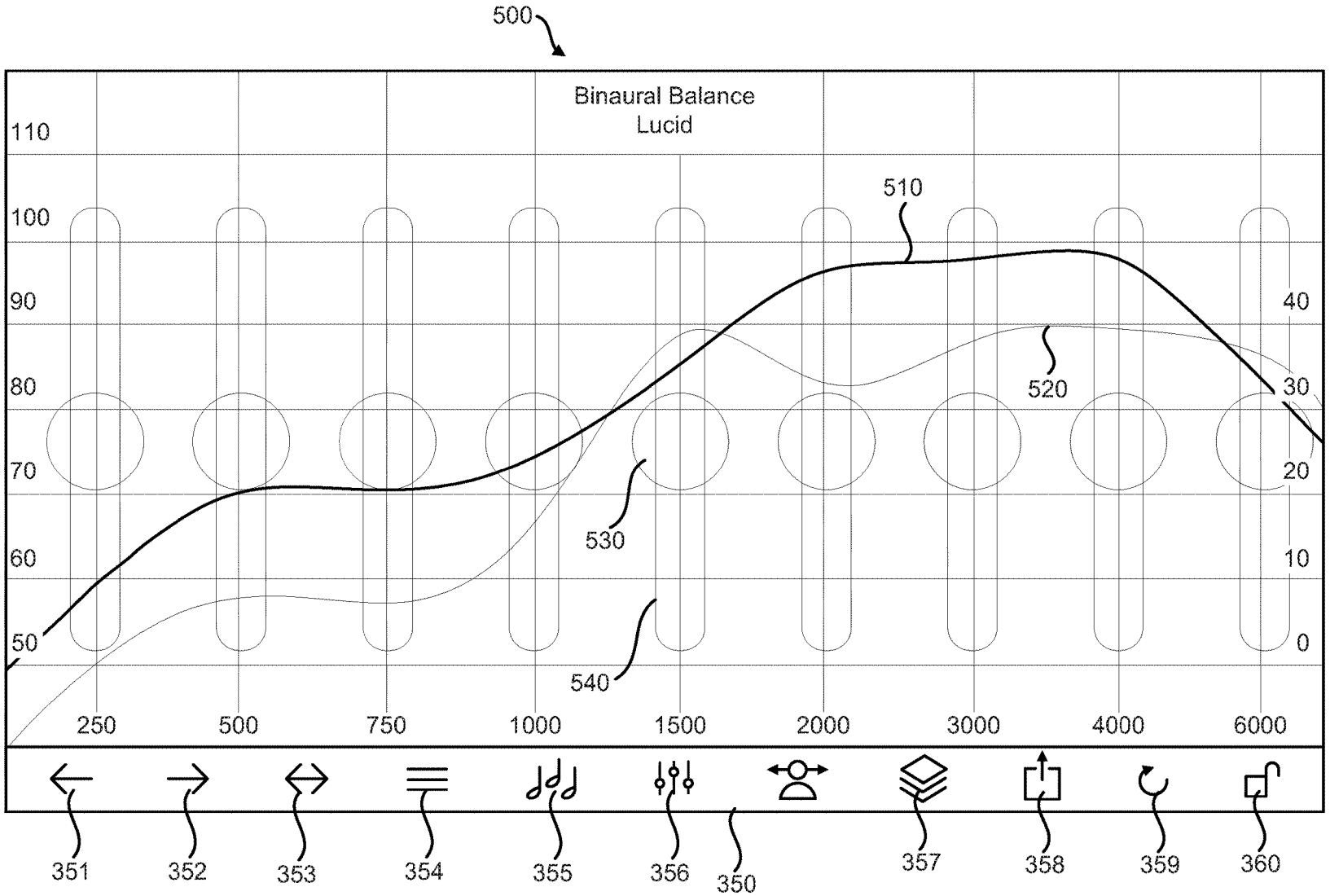
FIG. 5 illustrates a user interface screenshot of exemplary selectable loudness balance adjustments for a plurality of frequency ranges, in accordance with embodiments of the present technology.
Figure 6:
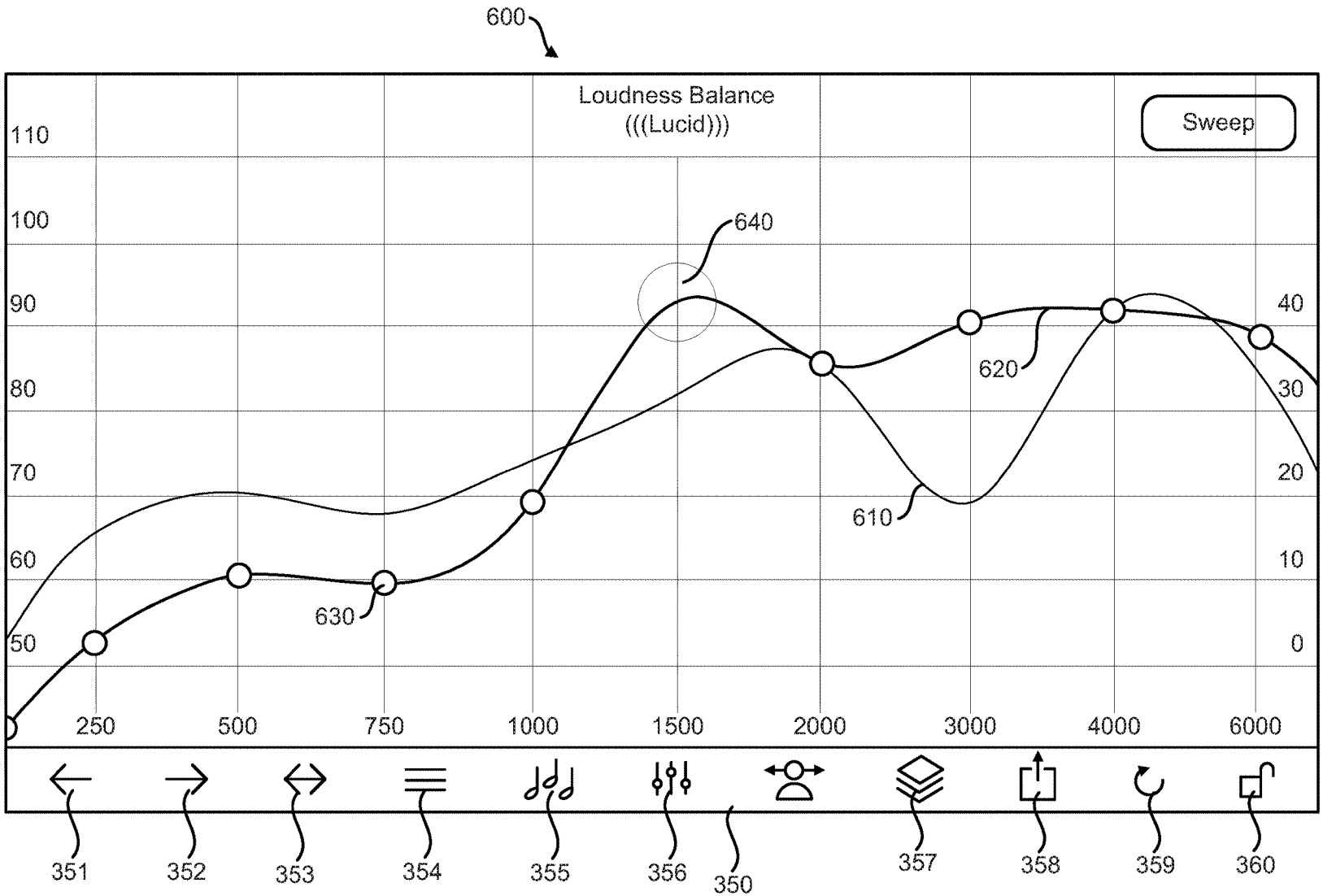
FIG. 6 illustrates a user interface screenshot of exemplary selectable binaural balance adjustments for a plurality of narrow frequency bands, in accordance with embodiments of the present technology.

Referring to FIG. 3, a user interface screenshot 300 of an exemplary comfort target 320 for a left hearing aid, by frequency, with a default target 310 predicted by audiogram is shown. For example, the default target curve 310 may correspond with the original complete fitting data set and the comfort target curve 320 may correspond with the substitute complete fitting data set as modified by a user of the mobile device 110. The default target curve 310 and comfort target curve 320 may be most comfortable level (MCL) curves, or any suitable curves. The user interface 300 may include user selectable tools or options 350, such as to select display of curves corresponding with a left hearing aid 351, a right hearing aid 352, both hearing aids 353, display of dependent data curves 354, an option to perform an automatic sequential sweep of audio stimulus test signals across a range of frequencies 355, an option to modify the comfort target curve 356, a program selector option 357, an option to save the substitute complete fitting data set at the hearing aid 358, an option 359 to revert to the original complete fitting data set 920 and/or forget session changes 930, an option to lock programming 360, or any suitable tools or options. In various embodiments, the comfort target curve 320 may be modifiable by a user selecting a sampling point of the curve 320 and dragging the sampling point up or down. As an example, the sampling points may correspond with user interface objects that may be hidden (as shown in FIG. 3) or displayed (as shown in FIGS. 5 and 6). Modifications of the sampling points results in the real-time update of the continuous curve 320 by interpolation of the modified sampling points. The modified sampling points are provided as an updated reduced size fitting data set communicated to the hearing aid 130 for application to input audio. In an exemplary embodiment, the user interface 300 may be presented in response to a user selected option or tool 351.

Figure 4:
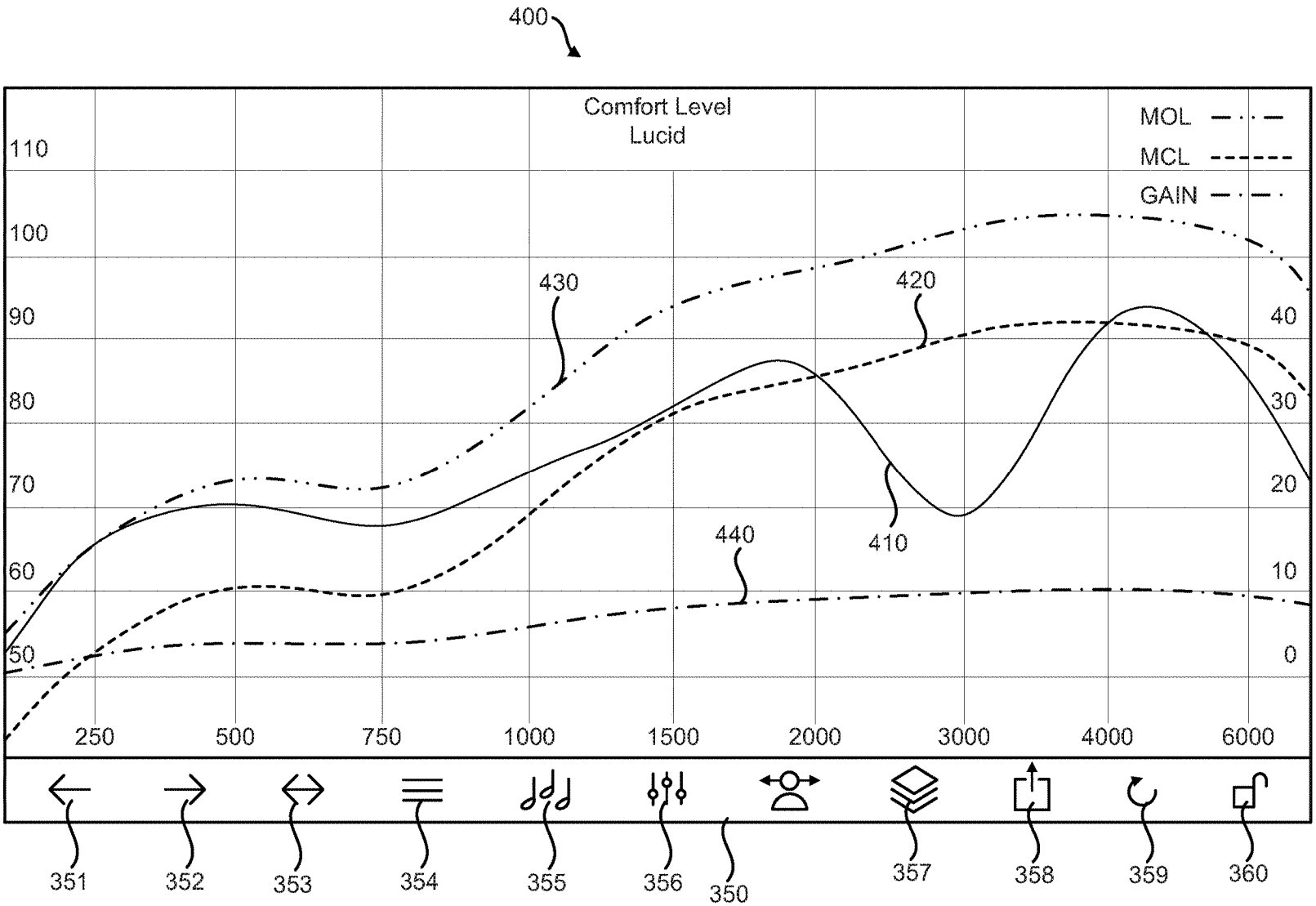
FIG. 4 illustrates a user interface screenshot of an exemplary advanced view of a right hearing aid most comfortable level (MCL) with a maximum output level (MOL) target curve and a maximum gain curve, in accordance with embodiments of the present technology.

Referring to FIG. 4, a user interface screenshot 400 of an exemplary advanced view of a right hearing aid most comfortable level (MCL) 420 with a maximum output level (MOL) target curve 430 and a maximum gain curve 440 is shown. The user interface 400 may display a default target curve 410 corresponding to the original complete fitting data set, an MCL curve 420 corresponding with the substitute complete fitting data set as modified by a user of the mobile device 110, and curves 430, 440 dependent on the MCL curve 420, such as an MOL target curve 430, a maximum gain curve 440, a minimum gain curve, and/or any suitable dependent curve. As discussed above with respect to FIG. 3, the MCL curve 420 may be modifiable by a user selecting a sampling point of the curve 420 and dragging the sampling point up or down. As an example, the sampling points may correspond with user interface objects that may be hidden (as shown in FIG. 4) or displayed (as shown in FIGS. 5 and 6). Modifications of the sampling points results in the real-time update of the continuous curve 420 and dependent curves 430, 440 by interpolation of the modified sampling points. The modified sampling points are provided as an updated reduced size fitting data set communicated to the hearing aid 130 for application to input audio. In an exemplary embodiment, the user interface 400 may be presented in response to a user selected option or tool 354.

Referring to FIG. 5, a user interface screenshot 500 of exemplary user-selectable loudness balance adjustments for a plurality of frequency ranges is shown. The user interface 500 may include a left hearing aid MCL curve 510, a right hearing aid MCL curve 520, and a plurality of user interface objects 530, 540 each corresponding to a sampling point of a reduced size fitting data set. The user interface objects 530, 540 may include a slider 530 operable to slide within a sliding range 540 that defines an adjustment range of the sampling point. Although sliders 530 are shown for adjusting the sampling point of each band, other graphical user interface elements may be implemented, such as handles (as shown in FIG. 6), hidden user interface objects (as described above with respect to FIGS. 3 and 4), selectable numerical or textual levels, increase and decrease buttons, drop down menu selections, and the like. In various embodiments, the hearing aid 130 may be configured to play source tones in a narrow band, and a user may adjust each frequency range to loudness such that all bands are perceived as equal loudness at the most comfortable level. The process may be performed monaurally (i.e., for each hearing aid side). In an exemplary embodiment, the user interface 500 may be presented in response to a user selected option or tool 356. Similar to real-ear measurement (REM) techniques, providing in-situ loudness balancing eliminates the need for estimates and transformations used in traditional fitting algorithms, such as using population normal data to predict MCL, or using standardized transformations to account for the acoustic effects of a unique ear canal on free-field audio input.

Referring to FIG. 6, a user interface screenshot 600 of exemplary selectable binaural balance adjustments for a plurality of narrow frequency bands is shown. The user interface 600 may include a right hearing aid default MCL target curve 610 corresponding to the original complete fitting data set and a right hearing aid MCL curve 620 corresponding with the substitute complete fitting data set as modified by a user of the mobile device 110. The user interface 600 may include a plurality of user interface objects 630, 640 each corresponding to a sampling point of a reduced size fitting data set. The user interface objects 630, 640 may include handles operable to be dragged up or down to adjust a corresponding sampling point. Although handles 630, 640 are shown for adjusting the sampling point of each band, other graphical user interface elements may be implemented, such as sliders (as shown in FIG. 5), hidden user interface objects (as described above with respect to FIGS. 3 and 4), selectable numerical or textual levels, increase and decrease buttons, drop down menu selections, and the like. In various embodiments, the hearing aid 130 may be configured to play source audio in narrow bands in both the left and right hearing aids simultaneously, and a user may adjust the binaural balance until the sounds are perceived as located in the medial plane. In certain embodiments, the user interface object 640 corresponding with the current narrow band being played may be enlarged as shown in FIG. 6. In an exemplary embodiment, the user interface 600 may be presented in response to a user selected option or tool 355.

Figure 7:
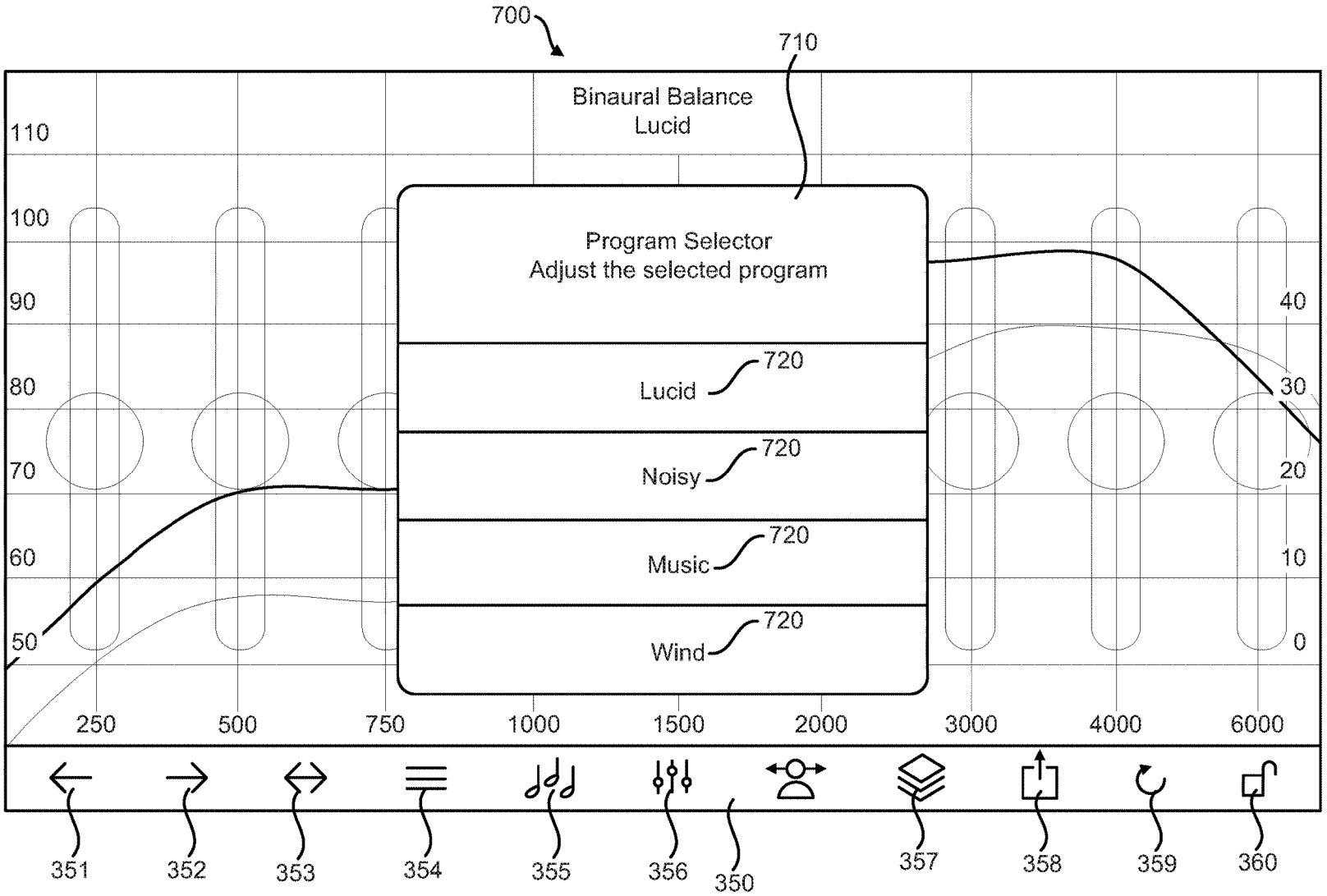
FIG. 7 illustrates a user interface screenshot of an exemplary program selector for adjusting settings of a selected program, in accordance with embodiments of the present technology.

Referring to FIG. 7, a user interface screenshot 700 of an exemplary program selector 710 for adjusting settings of a selected program 720 is shown. The user interface 700 may include a prompt 710 for selecting a program 720 to adjust. For example, the prompt 710 may be presented in response to a user selected option or tool 357. Adjustments may be made for independent programs in the hearing aid 130, such as a noisy environment program, a windy environment program, a music listening program, a standard program, and/or any suitable program. In various embodiments, each program 720 is an independent set of configuration parameters, optimized for unique acoustic environments and selected by the user. The interactive mobile hearing aid fitting application provides an option for selecting the particular program 720 being adjusted. In certain embodiments, the interactive mobile hearing aid fitting application may similarly provide options for storing a substitute complete fitting data set as a program and/or selecting a program to apply at the hearing aid 130.

Figure 8:
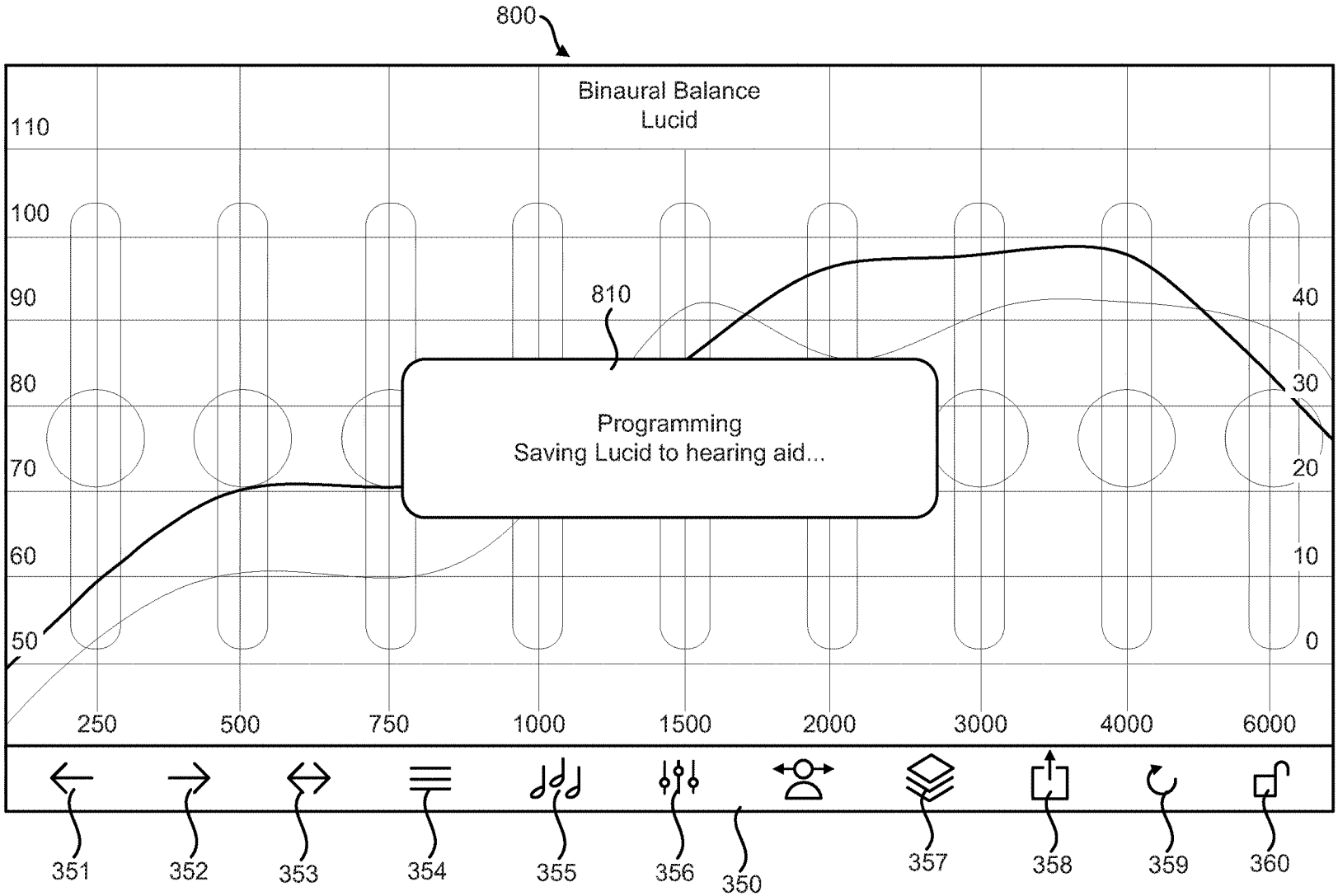
FIG. 8 illustrates a user interface screenshot of an exemplary indication that selected settings are being stored to the hearing aid, in accordance with embodiments of the present technology.

Referring to FIG. 8, a user interface screenshot 800 of an exemplary indication 810 that selected settings are being stored to the hearing aid is shown. For example, a user may determine when to commit the substitute complete fitting data to nonvolatile memory 134 in the hearing aids 130. In an exemplary embodiment, the user interface 800 may be presented in response to a user selected option or tool 358.

Figure 9:
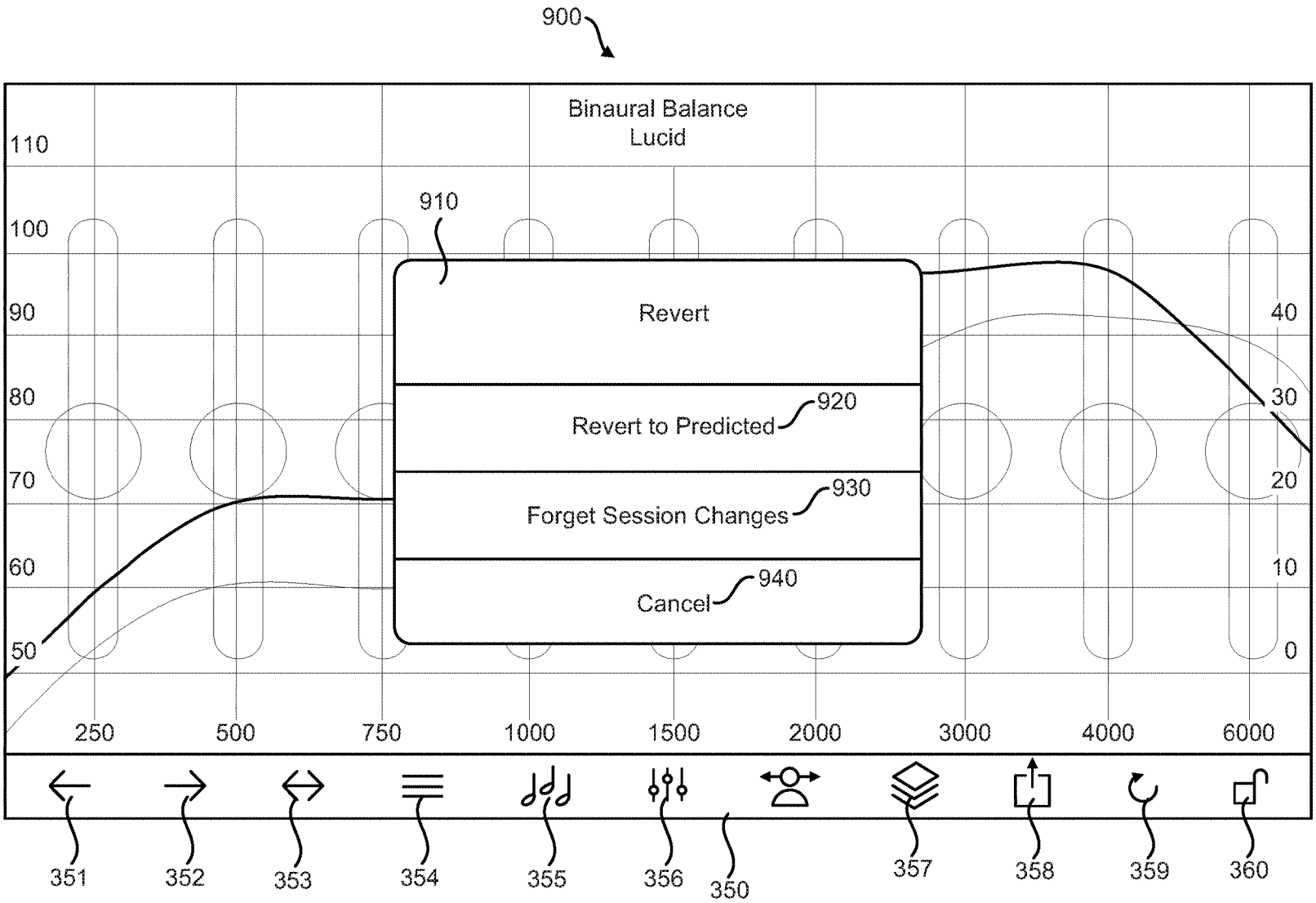
FIG. 9 illustrates a user interface screenshot of exemplary user-selectable options for discarding setting changes or reverting to previous settings, in accordance with embodiments of the present technology.

Referring to FIG. 9, a user interface screenshot 900 of exemplary user-selectable options 910 for discarding setting changes 930 or reverting to previous settings 920 is shown. The user interface 900 may include a prompt 910 providing options to revert to an original complete fitting data set 920, discarding a substitute complete filing data set 930, canceling the prompt 910, and/or any suitable option. The prompt 910 may be presented in response to a user selected option or tool 359. For example, the interactive mobile hearing aid fitting application may include options for allowing users to restart from a safe initial condition, in case the user has deviated from a useful configuration.

Figure 10:
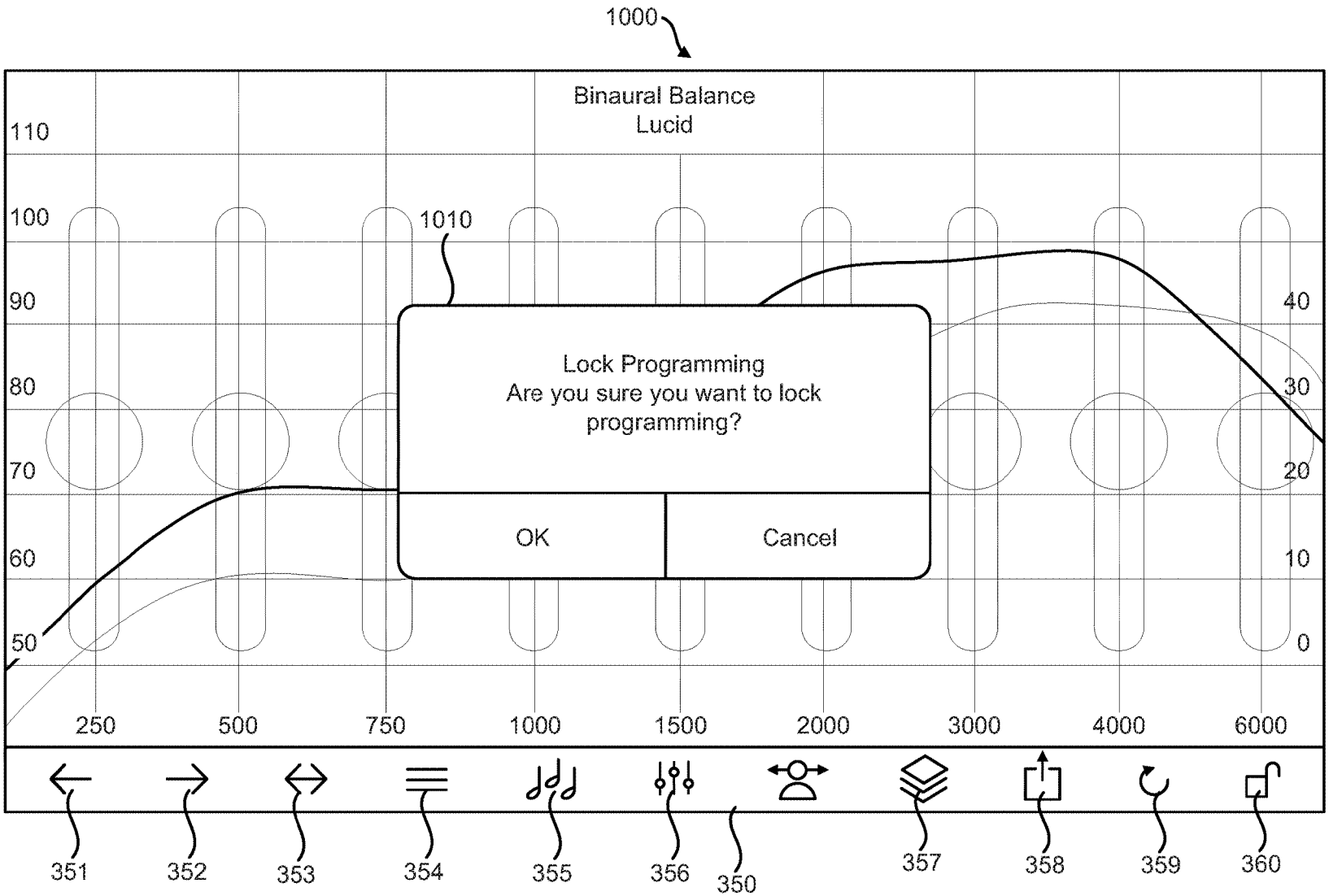
FIG. 10 illustrates a user interface screenshot of an exemplary user-selectable option to lock programing to temporarily prevent accidental modifications to a fitting, in accordance with embodiments of the present technology.

Referring to FIG. 10, a user interface screenshot 1000 of an exemplary user-selectable option 1010 to lock programing to temporarily prevent accidental modifications to a fitting is shown. For example, the interactive mobile hearing aid fitting application may include an option 1010 for locking the screen, to temporarily prevent accidental modifications to a fitting that has been settled. The option 1010 may be presented in response to a user selected option or tool 360.

Figure 11:
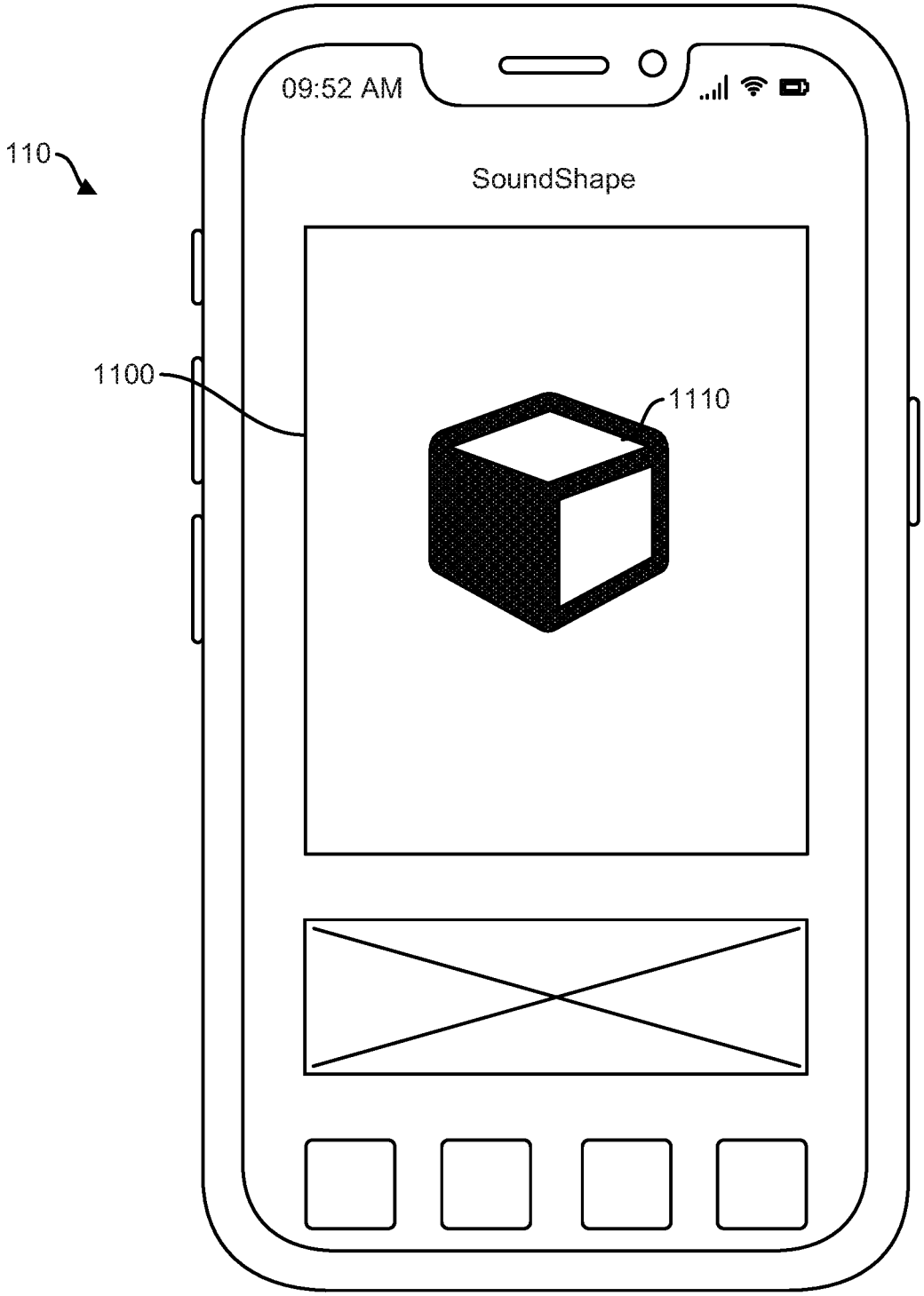
FIG. 11 illustrates a mobile device having a touchscreen display providing a user interface presenting a continuous fitting curve represented as a cube shape, in accordance with embodiments of the present technology.
Figure 12:
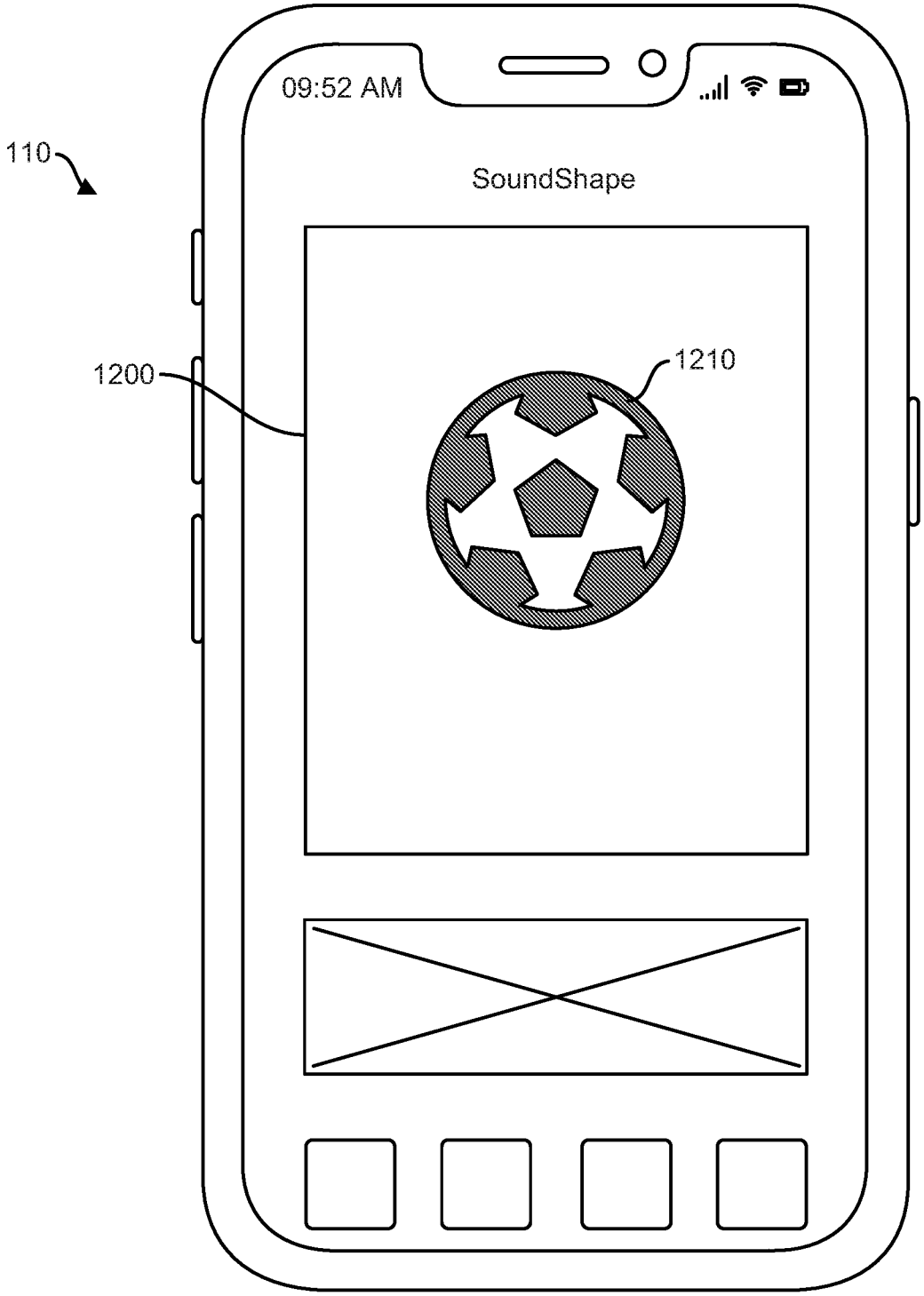
FIG. 12 illustrates a mobile device having a touchscreen display providing a user interface presenting a continuous fitting curve represented as a soccer ball shape, in accordance with embodiments of the present technology.

FIG. 11 illustrates a mobile device 110 having a touchscreen display providing a user interface 1100 presenting a continuous fitting curve represented as a cube shape 1110, in accordance with embodiments of the present technology. FIG. 12 illustrates a mobile device 110 having a touchscreen display providing a user interface 1200 presenting a continuous fitting curve represented as a soccer ball shape 1210, in accordance with embodiments of the present technology.

Referring to FIGS. 11 and 12, the user interface 1100, 1200 may include a continuous fitting curve represented by a shape 1110, 1210 and a plurality of user interface objects each corresponding to sampling points of a reduced size fitting data set. The shape 1110, 1210 may be a two-dimensional shape or three-dimensional shape. The shape 1110, 1210 may be a square, cube 1110, circle, oval, or any suitable shape. The shape may correspond with the shape of an object, such as a soccer ball 1210, star, apple, or any suitable object. The user interface objects may be sides, corners, edges, outer boundaries, points, or any suitable portions of the shape 1110, 1210. The user interface objects may be manipulated, rotated or otherwise selected by the user through gesture controls such as dragging one's finger around the user interface 1100, 1200 to move, rotate or otherwise change the shape 1110, 1210 that appears on the touchscreen. The different sides or facets of the shape 1110, 1210 may be designated by different colors, shading, numbers, or any suitable indicator to help visualize which part of the shape 1110, 1210 is selected and active. These different sides or facets of the shape 1110, 1210 can in turn be mapped to sampling point combinations representing different configurations of the continuous fitting curve. Additional hearing aid acoustic parameter settings may also be included in the various combinations. The different markings on the shape 1110, 1210 may allow the user to experiment with the shape 1110, 1210 and its corresponding hearing aid acoustic performance, and provide a way to guide the user to remember user preferences by associating the acoustic experience with the color, shading, or marking on the shape 1110, 1210.

As the user rotates, manipulates, or otherwise selects the user interface objects of the onscreen digital shape 1110, 1210, the corresponding value adjustments of the one or more sampling points are received by the mobile device processor. Modifications of the sampling points results in the real-time update of the continuous curve and dependent curves by interpolation of the modified sampling points. The modified sampling points are provided as an updated reduced size fitting data set communicated to the hearing aid 130 for application to input audio. In an exemplary embodiment, the user interface 1100, 1200 may be presented in response to a user selected option or tool. Different shapes may represent different levels of control. For example, a simple control might include a 6 sided cube 1110 as shown in FIG. 11, with each of the 6 sides representing a specific combination of sampling point values, whereas a more complex shape, like a soccer ball 1210 as shown in FIG. 12, may offer a larger number of facets representing a larger number of combinations of sampling point values.

Aspects of the present disclosure provide a method 200 and system 100 for interactive mobile fitting of hearing aids. In accordance with various embodiments, the method 200 may comprise receiving 202, by at least one processor 113 of a mobile device 110 from a hearing aid 130 communicatively coupled to the mobile device 110, a reduced size fitting data set 119, 115 having a set of sampling points less than a number of data points in a complete fitting data set. The method 200 may comprise interpolating 204, by the at least one processor 113, 116, the reduced size fitting data set 115 into a continuous fitting curve 117, 320, 420, 510, 520, 620 (i.e., represented by a high resolution array of discrete samples that is presented as a smooth curve). The method 200 may comprise presenting 206, at a display 111 of the mobile device 110, the continuous fitting curve 117, 320, 420, 510, 520, 620 with user interface objects 530, 540, 630, 640, each of the user interface objects 530, 540, 630, 640 corresponding with one or more sampling points of the set of sampling points. The method 200 may comprise receiving 208, at a user interface 111 of the mobile device 110, a user input 118 manipulating at least one of the user interface objects 530, 540, 630, 640, wherein the user input 118 adjusts a value of the one or more sampling points corresponding to the at least one of the user interface objects 530, 540, 630, 640 to generate an updated reduced size fitting data set 115, 119. The method 200 may comprise communicating 210 the updated reduced size fitting data set 115, 119 to the hearing aid 130. The method 200 may comprise generating 212, by at least one hearing aid processor 135, a substitute complete fitting data set 137 based on the updated reduced size fitting data set 136. The method 200 may comprise applying 214, by the at least one hearing aid processor 135, the substitute complete fitting data set 139 to input audio to generate modified audio. The method 200 may comprise outputting 216 the modified audio from the hearing aid 130, 132.

In a representative embodiment, the display 111 and the user interface 111 of the mobile device 110 are a touchscreen display 111. In an exemplary embodiment, the interpolating 204 the reduced size data set 115 comprises generating piecewise polynomial curves between sampling points of the set of sampling points. In various embodiments, the complete fitting data set is generated based at least in part on one or more of: an audiogram, an otoacoustic emissions (OAE) measurement, and a hearing-in-noise test. In certain embodiments, the receiving 208 the user input 118 manipulating the at least one of the user interface objects 530, 540, 630, 640 and the outputting 218 the modified audio are performed at substantially a same time (i.e., within 500 ms). In a representative embodiment, the input audio is one of a live ambient environment, band-limited audio stimulus test signals sourced from within the hearing aid 130, or an automatic sequential sweep of audio stimulus test signals across a range of frequencies. In an exemplary embodiment, the method 200 may comprise receiving 218-224, at the user interface 111 of the mobile device 110, an additional user input 358, 359, 720, 920, 930 to one or more of: discard 224 the updated reduced size fitting data set and revert back to the complete fitting data set for application to the input audio by the hearing aid processor 135, 139, save 226 the substitute complete fitting data set at nonvolatile memory 134 of the hearing aid 130 for application to the input audio by the hearing aid processor 135, 139, or save 226 the substitute complete fitting data set at the nonvolatile memory 134 of the hearing aid 130 as a program selectable 720 from the mobile device 110. In certain embodiments, the continuous fitting curve 117, 320, 420, 510, 520, 620 presented at the display 111 of the mobile device 110 may be represented by a shape 1110, 1210 having the user interface objects represented by different facets of the shape 1110, 1210. In a representative embodiment, the each of the user interface objects 530, 540, 630, 640 corresponds with only one of the sampling points of the set of sampling points.

Various embodiments provide an interactive mobile fitting system 100 comprising a mobile device 110 and a hearing aid 130. The mobile device 110 may comprise at least one processor 113, a mobile device communication component 112, and a display 111. The at least one processor 113 may be configured to interpolate 116 a reduced size fitting data set 115 into a continuous fitting curve 117, 320, 420, 510, 520, 620 (i.e., represented by a high resolution array of discrete samples that is presented as a smooth curve). The reduced size fitting data set 115 having a set of sampling points less than a number of data points in a complete fitting data set. The at least one processor 113 may be configured to present the continuous fitting curve 117, 320, 420, 510, 520, 620 with user interface objects 530, 540, 630, 640 at a display 111. Each of the user interface objects 530, 540, 630, 640 may correspond with one or more sampling points of the set of sampling points. The at least one processor 113 may be configured to receive a user input 118 manipulating at least one of the user interface objects 530, 540, 630, 640. The user input 118 adjusts a value of the one or more sampling points corresponding to the at least one of the user interface objects 530, 540, 630, 640 to generate an updated reduced size fitting data set 115. The mobile device communication component 112 may be configured to: wirelessly receive the reduced size fitting data set 119 from a hearing aid 130 communicatively coupled to the mobile device 110, and wirelessly communicate the updated reduced size fitting data 119 set to the hearing aid 130. The display 111 may be configured to display the continuous fitting curve 117, 320, 420, 510, 520, 620 with user interface objects 530, 540, 630, 640. The hearing aid 130 may comprise at least one hearing aid processor 135, a hearing aid communication component 133, and a receiver 132. The at least one hearing aid processor 135 may be configured to generate a substitute complete fitting data set 137 based on the updated reduced size fitting data set 136. The at least one hearing aid processor 135 may be configured to apply 139 the substitute complete fitting data set 137 to input audio to generate modified audio. The hearing aid communication component 133 may be configured to wirelessly communicate the reduced size fitting data set 140 to the mobile device 110, and wirelessly receive the updated reduced size fitting data set 140 from the mobile device 110. The receiver 132 may be configured to output the modified audio from the hearing aid 130.

In an exemplary embodiment, the display 111 is a touch-screen display 111 configured to receive the user input 118 manipulating the at least one of the user interface objects 530, 540, 630, 640. In various embodiments, the at least one processor 113 may be configured to interpolate 116 the reduced size data set 115 by generating piecewise polynomial curves between sampling points of the set of sampling points. In certain embodiments, the complete fitting data set is generated based at least in part on one or more of an audiogram, an otoacoustic emissions (OAE) measurement, and a hearing-in-noise test. In a representative embodiment, the user input 118 manipulating the at least one of the user interface objects 530, 540, 630, 640 and the output 132 of the modified audio are performed at substantially a same time (i.e., within 500 ms). In an exemplary embodiment, the input audio is one of a live ambient environment, band-limited audio stimulus test signals sourced from within the hearing aid 130, or an automatic sequential sweep of audio stimulus test signals across a range of frequencies. In various embodiments, the hearing aid comprises nonvolatile memory 134. The at least one processor 113 of the mobile device 110 may be configured to receive an additional user input 358, 359, 720, 920, 930 to one or more of: discard the updated reduced size fitting data set and revert back to the complete fitting data set for application to the input audio by the at least one hearing aid processor 135, 139, save the substitute complete fitting data set at the nonvolatile memory 134 of the hearing aid 130 for application to the input audio by the at least one hearing aid processor 135, 139, or save the substitute complete fitting data set at the nonvolatile memory 134 of the hearing aid 130 as a program 720 selectable from the mobile device 110. In certain embodiments, the continuous fitting curve 117, 320, 420, 510, 520, 620 presented at the display 111 of the mobile device 110 may be represented by a shape 1110, 1210 having the user interface objects represented by different facets of the shape 1110, 1210. In a representative embodiment, the each of the user interface objects 530, 540, 630, 640 corresponds with only one of the sampling points of the set of sampling points.

Certain embodiments provide a non-transitory computer readable medium having stored thereon, a computer program having at least one code section, the at least one code section being executable by a machine for causing a mobile device 110 to perform steps 200. The steps 200 may comprise receiving 202 a reduced size fitting data set 115, 119 from a hearing aid 130 communicatively coupled to the mobile device 110. The reduced size fitting data set includes a set of sampling points less than a number of data points in a complete fitting data set stored at the hearing aid 130. The steps 200 may comprise interpolating 204 the reduced size fitting data set 115 into a continuous fitting curve 117, 320, 420, 510, 520, 620 (i.e., represented by a high resolution array of discrete samples that is presented as a smooth curve). The steps 200 may comprise presenting 206 the continuous fitting curve 117, 320, 420, 510, 520, 620 with user interface objects 530, 540, 630, 640 at a display 111 of the mobile device 110. Each of the user interface objects 530, 540, 630, 640 may correspond with one or more sampling points of the set of sampling points. The steps 200 may comprise receiving 208 a user input 118 manipulating at least one of the user interface objects 530, 540, 630, 640. The user input 118 may adjust a value of the one or more sampling points corresponding to the at least one of the user interface objects 530, 540, 630, 640 to generate an updated reduced size fitting data set 115. The steps 200 may comprise communicating 210 the updated reduced size fitting data set 115, 119 to the hearing aid 130 used to create 212 a substitute complete fitting data set 137 applied 214 to input audio to generate modified audio 139 output 132 from the hearing aid 130.

In various embodiments, the interpolating 204 the reduced size data set 115 comprises generating piecewise polynomial curves between sampling points of the set of sampling points. In certain embodiments, the complete fitting data set is generated based at least in part on one or more of an audiogram, an otoacoustic emissions (OAE) measurement, and a hearing-in-noise test. In a representative embodiment, the input audio is one of a live ambient environment, band-limited audio stimulus test signals sourced from within the hearing aid 130, or an automatic sequential sweep of audio stimulus test signals across a range of frequencies. In an exemplary embodiment, the receiving 208 the user input 118 manipulating the at least one of the user interface objects 530, 540, 630, 640 and the output 216 of the modified audio at the hearing aid 130 are performed at substantially a same time (i.e., within 500 ms). In various embodiments, the steps 200 may comprise receiving 218-224 an additional user input 358, 359, 720, 920, 930 to one or more of: discard 224 the updated reduced size fitting data set and revert back to the complete fitting data set for application to the input audio by the hearing aid 130, 135, 139, save 226 the substitute complete fitting data set at nonvolatile memory 134 of the hearing aid 130 for application to the input audio by the hearing aid 130, 135, 139, or save 226 the substitute complete fitting data set at the nonvolatile memory 134 of the hearing aid 130 as a program selectable 720 from the mobile device 110. In certain embodiments, the continuous fitting curve 117, 320, 420, 510, 520, 620 presented at the display 111 of the mobile device 110 may be represented by a shape 1110, 1210 having the user interface objects represented by different facets of the shape 1110, 1210. In a representative embodiment, the each of the user interface objects 530, 540, 630, 640 corresponds with only one of the sampling points of the set of sampling points.

As utilized herein the term "circuitry" refers to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g.," and "for example" set off lists of one or more non-limiting examples, instances, or illustrations. As utilized herein, circuitry is "operable" and/or "configured" to perform a function whenever the circuitry comprises the necessary hardware and code (if any is necessary) to perform the function, regardless of whether performance of the function is disabled, or not enabled, by some user-configurable setting.

Other embodiments may provide a computer readable device and/or a non-transitory computer readable medium, and/or a machine readable device and/or a non-transitory machine readable medium, having stored thereon, a machine code and/or a computer program having at least one code section executable by a machine and/or a computer, thereby causing the machine and/or computer to perform the steps as described herein for interactive mobile fitting of hearing aids.

Accordingly, the present disclosure may be realized in hardware, software, or a combination of hardware and software. The present disclosure may be realized in a centralized fashion in at least one computer system, or in a distributed fashion where different elements are spread across several interconnected computer systems. Any kind of computer system or other apparatus adapted for carrying out the methods described herein is suited.

Various embodiments may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A method comprising:

receiving, by at least one processor of a mobile device from a hearing aid communicatively coupled to the mobile device, a reduced size fitting data set having a set of sampling points less than a number of data points in a complete fitting data set;

interpolating, by the at least one processor, the reduced size fitting data set into a continuous fitting curve;

presenting, at a display of the mobile device, the continuous fitting curve with user interface objects, each of the user interface objects corresponding with one or more sampling points of the set of sampling points;

receiving, at a user interface of the mobile device, a user input manipulating at least one of the user interface objects, wherein the user input adjusts a value of the one or more sampling points corresponding to the at least one of the user interface objects to generate an updated reduced size fitting data set;

communicating the updated reduced size fitting data set to the hearing aid;

generating, by at least one hearing aid processor, a substitute complete fitting data set based on the updated reduced size fitting data set;

applying, by the at least one hearing aid processor, the substitute complete fitting data set to input audio to generate modified audio; and outputting the modified audio from the hearing aid.

2. The method of claim 1, wherein the display and the user interface of the mobile device are a touchscreen display.

3. The method of claim 1, wherein the interpolating the reduced size data set comprises generating piecewise polynomial curves between sampling points of the set of sampling points.

4. The method of claim 1, wherein the complete fitting data set is generated based at least in part on one or more of:

an audiogram, an otoacoustic emissions (OAE) measurement, and a hearing-in-noise test.

5. The method of claim 1, wherein the receiving the user input manipulating the at least one of the user interface objects and the outputting the modified audio are performed at substantially a same time.

6. The method of claim 1, wherein the input audio is one of:

a live ambient environment, band-limited audio stimulus test signals sourced from within the hearing aid, or an automatic sequential sweep of audio stimulus test signals across a range of frequencies.

7. The method of claim 1, comprising receiving, at the user interface of the mobile device, an additional user input to one or more of:

discard the updated reduced size fitting data set and revert back to the complete fitting data set for application to the input audio by the hearing aid processor, save the substitute complete fitting data set at nonvolatile memory of the hearing aid for application to the input audio by the hearing aid processor, or save the substitute complete fitting data set at the non-volatile memory of the hearing aid as a program selectable from the mobile device.

8. The method of claim 1, wherein the continuous fitting curve presented at the display of the mobile device is represented by a shape having the user interface objects represented by different facets of the shape.

9. The method of claim 1, wherein the each of the user interface objects corresponds with only one of the sampling points of the set of sampling points.

10. An interactive mobile fitting system comprising:

a mobile device comprising:

at least one processor configured to:

interpolate a reduced size fitting data set into a continuous fitting curve, the reduced size fitting data set having a set of sampling points less than a number of data points in a complete fitting data set;

present the continuous fitting curve with user interface objects at a display, each of the user interface objects corresponding with one or more sampling points of the set of sampling points;

receive a user input manipulating at least one of the user interface objects, wherein the user input adjusts a value of the one or more sampling points corresponding to the at least one of the user interface objects to generate an updated reduced size fitting data set;

a mobile device communication component configured to:

wirelessly receive the reduced size fitting data set from a hearing aid communicatively coupled to the mobile device; and wirelessly communicate the updated reduced size fitting data set to the hearing aid; and the display configured to display the continuous fitting curve with user interface objects; and a hearing aid comprising:

at least one hearing aid processor configured to:

generate a substitute complete fitting data set based on the updated reduced size fitting data set; and apply the substitute complete fitting data set to input audio to generate modified audio;

a hearing aid communication component configured to:

wirelessly communicate the reduced size fitting data set to the mobile device; and wirelessly receive the updated reduced size fitting data set from the mobile device; and a receiver configured to output the modified audio from the hearing aid.

11. The interactive mobile fitting system of claim 10, wherein the display is a touchscreen display configured to receive the user input manipulating the at least one of the user interface objects.

12. The interactive mobile fitting system of claim 10, wherein the at least one processor is configured to interpolate the reduced size data set by generating piecewise polynomial curves between sampling points of the set of sampling points.

13. The interactive mobile fitting system of claim 10, wherein the complete fitting data set is generated based at least in part on one or more of:

an audiogram, an otoacoustic emissions (OAE) measurement, and a hearing-in-noise test.

14. The interactive mobile fitting system of claim 10, wherein the user input manipulating the at least one of the user interface objects and the output of the modified audio are performed at substantially a same time.

15. The interactive mobile fitting system of claim 10, wherein the input audio is one of:

a live ambient environment, band-limited audio stimulus test signals sourced from within the hearing aid, or an automatic sequential sweep of audio stimulus test signals across a range of frequencies.

16. The interactive mobile fitting system of claim 10, wherein:

the hearing aid comprises nonvolatile memory, and the at least one processor of the mobile device is configured to receive an additional user input to one or more of:

discard the updated reduced size fitting data set and revert back to the complete fitting data set for application to the input audio by the at least one hearing aid processor, save the substitute complete fitting data set at the non-volatile memory of the hearing aid for application to the input audio by the at least one hearing aid processor, or save the substitute complete fitting data set at the non-volatile memory of the hearing aid as a program selectable from the mobile device.

17. The interactive mobile fitting system of claim 10, wherein the continuous fitting curve presented at the display of the mobile device is represented by a shape having the user interface objects represented by different facets of the shape.

18. The interactive mobile fitting system of claim 10, wherein the each of the user interface objects corresponds with only one of the sampling points of the set of sampling points.

19. A non-transitory computer readable medium having stored thereon, a computer program having at least one code section, the at least one code section being executable by a machine for causing a mobile device to perform steps comprising:

receiving a reduced size fitting data set from a hearing aid communicatively coupled to the mobile device, the reduced size fitting data set having a set of sampling points less than a number of data points in a complete fitting data set stored at the hearing aid;

interpolating the reduced size fitting data set into a continuous fitting curve;

presenting the continuous fitting curve with user interface objects at a display of the mobile device, each of the user interface objects corresponding with one or more sampling points of the set of sampling points;

receiving a user input manipulating at least one of the user interface objects, wherein the user input adjusts a value of the one or more sampling points corresponding to the at least one of the user interface objects to generate an updated reduced size fitting data set; and communicating the updated reduced size fitting data set to the hearing aid used to create a substitute complete fitting data set applied to input audio to generate modified audio output from the hearing aid.

20. The non-transitory computer readable medium of claim 19, wherein the interpolating the reduced size data set comprises generating piecewise polynomial curves between sampling points of the set of sampling points.

21. The non-transitory computer readable medium of claim 19, wherein the complete fitting data set is generated based at least in part on one or more of:

an audiogram, an otoacoustic emissions (OAE) measurement, and a hearing-in-noise test.

22. The non-transitory computer readable medium of claim 19, wherein the input audio is one of:

a live ambient environment, band-limited audio stimulus test signals sourced from within the hearing aid, or an automatic sequential sweep of audio stimulus test signals across a range of frequencies.

23. The non-transitory computer readable medium of claim 19, wherein the receiving the user input manipulating the at least one of the user interface objects and the output of the modified audio at the hearing aid are performed at substantially a same time.

24. The non-transitory computer readable medium of claim 19, comprising receiving an additional user input to one or more of:

discard the updated reduced size fitting data set and revert back to the complete fitting data set for application to the input audio by the hearing aid, save the substitute complete fitting data set at nonvolatile memory of the hearing aid for application to the input audio by the hearing aid, or save the substitute complete fitting data set at the non-volatile memory of the hearing aid as a program selectable from the mobile device.

25. The non-transitory computer readable medium of claim 19, wherein the continuous fitting curve presented at the display of the mobile device is represented by a shape having the user interface objects represented by different facets of the shape.

26. The non-transitory computer readable medium of claim 19, wherein the each of the user interface objects corresponds with only one of the sampling points of the set of sampling points.

* * * * *